US006707438B1

(12) United States Patent
Ishizuka et al.

(10) Patent No.: US 6,707,438 B1
(45) Date of Patent: Mar. 16, 2004

(54) APPARATUS AND METHOD FOR DRIVING MULTI-COLOR LIGHT EMITTING DISPLAY PANEL

(75) Inventors: Shinichi Ishizuka, Tsurugashima (JP); Hideo Ochi, Tsurugashima (JP); Tsuyoshi Sakamoto, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 91 days.

(21) Appl. No.: 09/624,194

(22) Filed: Jul. 24, 2000

(30) Foreign Application Priority Data

Jul. 27, 1999 (JP) ..... 11-212432

(51) Int. Cl.[7] ..... G09G 3/30
(52) U.S. Cl. ..... 345/78; 345/77; 315/169.3
(58) Field of Search ..... 345/76, 77, 78, 345/589, 596, 597, 690; 315/169.1, 169.3

(56) References Cited

U.S. PATENT DOCUMENTS 4,642,524 A 2/1987 Eaton et al. ..... 315/169.3
4,684,942 A 8/1987 Nishi
5,075,596 A * 12/1991 Young et al. ..... 315/167
5,317,334 A 5/1994 Sano
5,424,560 A * 6/1995 Norman et al. ..... 257/103
5,448,024 A 9/1995 Kawaguchi
5,719,589 A * 2/1998 Norman et al. ..... 345/209
5,812,105 A * 9/1998 Van de Ven ..... 345/83
5,828,181 A * 10/1998 Okuda ..... 315/169.3
5,838,289 A * 11/1998 Saito et al. ..... 345/212
5,844,368 A * 12/1998 Okuda et al. ..... 315/169.1
5,847,516 A * 12/1998 Kishita et al. ..... 315/169.1
5,856,813 A * 1/1999 Katayama et al. ..... 345/208
5,872,561 A * 2/1999 Figie et al. ..... 341/22
5,923,309 A * 7/1999 Ishizuka et al. ..... 345/690
5,973,456 A * 10/1999 Osada et al. ..... 315/169.1
6,339,415 B2 * 1/2002 Ishizuka ..... 345/76
6,351,255 B1 * 2/2002 Ishizuka et al. ..... 345/77

* cited by examiner

*Primary Examiner*—Bipin Shalwala
*Assistant Examiner*—Ricardo Osorio
(74) *Attorney, Agent, or Firm*—Morgan, Lewis & Bockius LLP

(57) ABSTRACT

A driving apparatus for a multi-color light-emitting display panel including drive lines and scanning lines intersecting with each other, and capacitive light-emitting elements which have polarities connected to the scanning lines and the drive lines at the intersections and which are divided into a plurality of types by a color of light emission, the capacitive light-emitting elements of the same type being arranged on each drive line. The drive apparatus comprises a scanning circuit for selectively supplying a first potential and a second potential higher than the first potential to each of the scanning lines, and a drive circuit for selectively supplying a drive current from a current source and a third a potential for an offset voltage not higher than a light emission threshold voltage of the element to each of the drive lines, the drive current and the third potential are variable.

12 Claims, 20 Drawing Sheets

FIG.17

| LEVELS OF HALFTONE | | 0 | 1 | 2 | -------- | 29 | 30 | 31 |
|---|---|---|---|---|---|---|---|---|
| RED | DRIVE CURRENT | Ir0 | Ir1 | Ir2 | -------- | Ir29 | Ir30 | Ir31 |
| | OFFSET VOLTAGE | Vr0 | Vr1 | Vr2 | -------- | Vr29 | Vr30 | Vr31 |
| GREEN | DRIVE CURRENT | Ig0 | Ig1 | Ig2 | -------- | Ig29 | Ig30 | Ig31 |
| | OFFSET VOLTAGE | Vg0 | Vg1 | Vg2 | -------- | Vg29 | Vg30 | Vg31 |
| BLUE | DRIVE CURRENT | Ib0 | Ib1 | Ib2 | -------- | Ib29 | Ib30 | Ib31 |
| | OFFSET VOLTAGE | Vb0 | Vb1 | Vb2 | -------- | Vb29 | Vb30 | Vb31 |

FIG.18A $V_{eR}=25$ (V)

| OFFSET VOLTAGE $V_R$ (V) | −5 | −4 | −3 | −2 | −1 | 0 | +1 | +2 | +3 |
|---|---|---|---|---|---|---|---|---|---|
| REVERSE BIAS VOLTAGE Vcc (V) | 30 | 29 | 28 | 27 | 26 | 25 | 24 | 23 | 22 |

COMMON VOLTAGE RANGE

FIG.18B $V_{eG}=21$ (V)

| OFFSET VOLTAGE $V_G$ (V) | −5 | −4 | −3 | −2 | −1 | 0 | +1 | +2 | +3 |
|---|---|---|---|---|---|---|---|---|---|
| REVERSE BIAS VOLTAGE Vcc (V) | 26 | 25 | 24 | 23 | 22 | 21 | 20 | 19 | 18 |

COMMON VOLTAGE RANGE

FIG.18C $V_{eB}=20$ (V)

| OFFSET VOLTAGE $V_B$ (V) | −5 | −4 | −3 | −2 | −1 | 0 | +1 | +2 | +3 |
|---|---|---|---|---|---|---|---|---|---|
| REVERSE BIAS VOLTAGE Vcc (V) | 25 | 24 | 23 | 22 | 21 | 20 | 19 | 18 | 17 |

COMMON VOLTAGE RANGE

FIG.19

$V_{eR}=9$ (V)

| OFFSET VOLTAGE $V_R$ (V) | −5 | −4 | −3 | −2 | −1 | 0 | +1 | +2 | +3 |
|---|---|---|---|---|---|---|---|---|---|
| REVERSE BIAS VOLTAGE Vcc (V) | 14 | 13 | 12 | 11 | 10 | 9 | 8 | 7 | 6 |

APPARATUS AND METHOD FOR DRIVING MULTI-COLOR LIGHT EMITTING DISPLAY PANEL

BACKGROUND OF THE INVENTION

1. Field of the Invention

The present invention relates to a driving apparatus for a multi-color light-emitting display panel that uses capacitive light-emitting elements such as organic electroluminescence elements and a drive method for the same.

2. Description of the Related Art

In recent years, with the trend of increasing the size of display devices, thinner display devices have been required, and a variety of thin display devices have been brought into practical use. An electroluminescence display comprising a plurality of organic electroluminescence elements arranged in a matrix has drawn attention as one of the thin display devices.

As shown in FIG. 1, the organic electroluminescence element comprises at least one layer of an organic functional layer 102, made up of an electron transport layer, a light-emitting layer, a hole transport layer or the like, and a metallic electrode 103, stacked on a transparent substrate 100 of a glass plate or the like on which a transparent electrode 101 is formed. The organic functional layer 102 emits light by applying a positive voltage to the anode of the transparent electrode 101 and a negative voltage to the cathode of the metallic electrode 103, that is, by applying a current across the transparent electrode and the metallic electrode. The electroluminescence display is practicable by using, as the organic functional layer, an organic compound that can be expected to provide good light emission characteristics.

The organic electroluminescence element (hereinafter simply referred to as an EL element) can be represented electrically by an equivalent circuit as shown in FIG. 2. As can be seen from the drawing, the EL element can be replaced by a capacitance component C and a diode characteristic component E that is connected in parallel to the capacitance component. Therefore, the EL element can be considered a capacitive light-emitting element. In the EL element, when a DC light emission drive voltage is applied across the electrodes, electric charge is stored in the capacitance component C. When a barrier voltage or light emission threshold voltage, which corresponds to the element, is exceeded thereafter, a current starts to flow from the electrode (the anode of the diode component E) to the organic functional layer which serves as a light-emitting layer to allow the EL element to emit light at an intensity in proportion to the current.

As shown in FIG. 3, the characteristic of voltage V—current I—luminosity L of such an EL element is very similar to that of a diode, where the current I is extremely small at voltages not larger than the light emission threshold voltage Vth and suddenly increases at voltages equal to or larger than the light emission threshold voltage Vth. In addition, the current I is generally proportional to the luminosity L. In the EL element, when a drive voltage larger than the light emission threshold voltage Vth is applied to the EL element, the element emits light at luminosity proportional to the current corresponding to the drive voltage. On the other hand, when the drive voltage applied thereto is equal to or smaller than the light emission threshold voltage Vth, no drive current flows and the luminosity of light emission remains zero.

As a method for driving a light-emitting display panel that employs such EL elements, known is a simple matrix drive method. FIG. 4 shows the configuration of an example of a drive apparatus that uses the simple matrix drive method for a multi-color light-emitting display panel. In the light-emitting display panel, n cathode lines (metallic electrodes) $B_1, \ldots, B_n$ are provided in the horizontal direction and 3 m anode lines (transparent electrodes) $A_{1R}, A_{1G}, A_{1B}, \ldots, A_{mR}, A_{mG}, A_{mB}$ are provided in the vertical direction. EL elements $E_{1R,1}, E_{1G,1}, E_{1B,1}, E_{mR,n}, E_{mG,n}, E_{mB,n}$ are formed at the respective intersections (a total of n×3 m). The EL elements $E_{1R,1}, E_{mR,n}$ emit red light; the EL elements $E_{1G,1}, \ldots, E_{mG,n}$ emit green light; and EL elements $E_{1B,1}, \ldots, E_{mB,n}$ emit blue light. Three EL elements (for example, $E_{1R,1}, E_{1G,1}, E_{1B,1}$) of each of three primary colors of red, green, and blue, consecutive in each of the cathode lines, form one pixel. The EL elements $E_{1R,1}, E_{1G,1}, E_{1B,1}, \ldots, E_{mR,n}, E_{mG,n}, E_{mB,n}$ are arranged in the shape of lattice with one end thereof (the anode line side of the diode component E in the aforementioned equivalent circuit) connected to the anode lines and the other end thereof (the cathode side of the diode component E in the aforementioned equivalent circuit) connected to the cathode lines, corresponding to the intersections of the anode lines $A_{1R}, A_{1G}, A_{1B}, \ldots, A_{mR}, A_{mG}, A_{mB}$, which are directed along the vertical direction, and the cathode lines $B_1, \ldots, B_n$, which are directed along the horizontal direction. The cathode lines are connected to a cathode line scanning circuit 1, while the anode lines are connected to an anode line drive circuit 2 and an anode line reset circuit 3.

The cathode line scanning circuit 1 has scanning switches $\mathbf{5}_1, \ldots, \mathbf{5}_n$, corresponding to the cathode lines $B_1, \ldots, B_n$, for determining individually the electric potential of each of the cathode lines, each relaying and supplying either one of a positive potential Vcc which serves as a reverse bias voltage or the ground potential (0V) to a corresponding cathode line.

The anode line drive circuit 2 has current sources $\mathbf{2}_{1R}, \mathbf{2}_{1G}, \mathbf{2}_{1B}, \ldots, \mathbf{2}_{mR}, \mathbf{2}_{mG}, \mathbf{2}_{mB}$, (for example, constant current sources), corresponding to the anode lines $A_{1R}, A_{1G}, A_{1B}, \ldots, A_{mR}, A_{mG}, A_{mB}$, for supplying drive currents to individual EL elements through the respective anode lines, and drive switches $\mathbf{6}_{1R}, \mathbf{6}_{1G}, \mathbf{6}_{1B}, \ldots, \mathbf{6}_{mR}, \mathbf{6}_{mG}, \mathbf{6}_{mB}$. The anode line drive circuit 2 performs on/off control to allow the drive switches to supply currents to individual anode lines. Voltage sources such as constant voltage sources can be used as the drive sources. However, current sources (current circuits that are controlled to provide a desired amount of supply current) are generally used due to a fact that the aforementioned current—luminosity characteristic is stable against a variation in temperature, whereas the voltage—luminosity characteristic is unstable against a variation in temperature. The amount of supply current of the current sources $\mathbf{2}_{1R}, \mathbf{2}_{1G}, \mathbf{2}_{1B}, \ldots, \mathbf{2}_{mR}, \mathbf{2}_{mG}, \mathbf{2}_{mB}$ is an amount of current required for the EL elements to sustain a state of emitting light at desired instantaneous luminosity (hereinafter, this state is referred to as the steady light emitting state). In addition, the aforementioned capacitance component C of the EL element is charged with electric charge corresponding to the amount of supply current when the EL element is under a light-emitting state. Accordingly, the voltage across the EL element becomes a specified value Ve (hereinafter, this is referred to as the light emission regulating voltage).

The anode line reset circuit 3 has shunt switches $\mathbf{7}_{1R}, \mathbf{7}_{1G}, \mathbf{7}_{1B}, \ldots, \mathbf{7}_{mR}, \mathbf{7}_{mG}, \mathbf{7}_{mB}$, which are provided for each of the anode lines. The shunt switches are selected to set the cathode lines to the ground potential.

The cathode line scanning circuit 1, the anode line drive circuit 2, and the anode line reset circuit 3 are connected to a light emission control circuit 4.

The light emission control circuit 4 controls the cathode line scanning circuit 1, the anode line drive circuit 2, and the anode line reset circuit 3 to display, in accordance with image data supplied from an image data generation system (not shown), the image to be served by the image data. The light emission control circuit 4 generates a scanning line select control signal for the cathode line scanning circuit 1 to select one cathode line from the cathode lines $B_1, \ldots, B_n$, corresponding to a horizontal scanning period of the image data, so that the selected cathode line is set to the ground potential and the remaining cathode lines are supplied with the positive potential Vcc. The positive potential Vcc is applied to EL elements by constant voltage sources connected to the cathode lines to prevent the EL elements, which are connected to the intersections of the driven anode lines and the cathode lines which are not selected for scanning, from producing cross-talk light emission. The positive potential is set such that Vcc=Ve. As the scanning switches $\mathbf{5}_1, \ldots, \mathbf{5}_n$ are sequentially switched to the ground potential in each horizontal scanning period, a cathode line set at the ground potential functions as a scanning line which enables the EL elements connected thereto to emit light.

The anode line drive circuit 2 performs light emission control for the scanning line. The light emission control circuit 4 generates a drive control signal (a drive pulse) that shows which EL elements connected to the scanning line is allowed to emit light, the timing, and the duration of time for the light emission, in accordance with pixel color information shown by image data, and supplies the signal to the anode line drive circuit 2. In accordance with the drive control signal, the anode line drive circuit 2 turns on some of drive switches $\mathbf{6}_{1R}, \mathbf{6}_{1G}, \mathbf{6}_{1B}, \ldots, \mathbf{6}_{mR}, \mathbf{6}_{mG}, \mathbf{6}_{mB}$ to supply drive currents to the corresponding EL elements through the anode lines $A_{1R}, A_{1G}, A_{1B}, \ldots, A_{mR}, A_{mG}, A_{mB}$. This allows the EL elements to which drive currents are supplied to emit light in accordance with the pixel color information. Any color can be obtained depending on the light emission luminosity of each of the EL elements in a pixel or depending on the duration of time for light emission within a light emission period.

The reset operation of the anode line reset circuit 3 is carried out in accordance with the reset signal from the light emission control circuit 4. The anode line reset circuit 3 turns on some of the shunt switches $\mathbf{7}_{1R}, \mathbf{7}_{1G}, \mathbf{7}_{1B}, \ldots, \mathbf{7}_{mR}, \mathbf{7}_{mG}, \mathbf{7}_{mB}$, corresponding to the anode lines, shown by the reset control signal, to be reset, and turns off the remaining shunt switches.

Japanese Patent Laid-Open Publication No.Hei 9-232074, applied by the same applicant as the present applicant, discloses a drive method for performing a reset operation (hereinafter referred to as the reset drive method) in which electric charge stored in each EL element, disposed in a lattice shape, immediately before a scanning line is changed in a simple matrix display panel. This reset drive method is to accelerate the rise time of light emission in EL elements when a scanning line is changed. The reset drive method for a simple matrix display panel will be explained with reference to FIGS. 4 to 6.

The operation that is shown in FIGS. 4 to 6 and described below includes an example in which the cathode line $B_1$ is scanned to allow the EL elements $E_{1R,1}, E_{1G,1}, E_{1B,1}$, to emit light and thereafter, the scan is transferred to the cathode line $B_2$ to emit the EL elements $E_{2R,2}, E_{2G,2}, E_{2B,2}$. In addition, for the sake of clarity in explanation, EL elements that are emitting light are indicated by diode symbols, whereas those that are not emitting light are indicated by capacitor symbols. Moreover, the positive potential Vcc applied to the cathode lines $B_1, \ldots, B_n$ is made equal to the light emission regulating voltage Ve of an EL element.

Referring to FIG. 4, first, only scanning switch $\mathbf{5}_1$ is switched over to the ground potential of 0 (V) and the cathode line $B_1$ is scanned. The positive potential Vcc is applied to the remaining cathode lines $B_2, \ldots, B_n$ by means of the scanning switches $\mathbf{5}_2, \ldots, \mathbf{5}_n$. At the same time, the current sources $\mathbf{2}_{1R}, \mathbf{2}_{1G}, \mathbf{2}_{1B}$ are connected to the anode lines $A_{1R}, A_{1G}, A_{1B}$ by means of the drive switches $\mathbf{6}_{1R}, \mathbf{6}_{1G}, \mathbf{6}_{1B}$. In addition, the remaining anode lines $A_{2R}, A_{2G}, A_{2B}, \ldots, A_{mR}, A_{mG}, A_{mB}$ are switched over to the ground potential of 0 (v) by means of the shunt switches $\mathbf{7}_{2R}, \mathbf{7}_{2G}, \mathbf{7}_{2B}, \ldots, \mathbf{7}_{mR}, \mathbf{7}_{mG}, \mathbf{7}_{mB}$. Thus, in the case of FIG. 4, a voltage is applied to only the EL elements $E_{1R,1}, E_{1G,1}, E_{1B,1}$ in the forward direction, where drive currents flow in from the current sources $\mathbf{2}_{1R}, \mathbf{2}_{1G}, \mathbf{2}_{1B}$, as indicated by arrows, to allow only the EL elements $E_{1R,1}, E_{1G,1}, E_{1B,1}$ to emit light. In this state, the EL elements $E_{2R,2}, E_{2G,2}, E_{2B,2}, \ldots, E_{mR,n}, E_{mG,n}, E_{mB,n}$ which emit no light and are indicated by hatching, are charged in the direction of the polarity shown in the figure.

The following reset control is carried out immediately before the scan is transferred from the light-emitting state of FIG. 4 to the state where the subsequent EL elements $E_{2R,2}, E_{2G,2}, E_{2B,2}$ emit light. That is, as shown in FIG. 5, all the drive switches $\mathbf{6}_{1R}, \mathbf{6}_{1G}, \mathbf{6}_{1B}, \ldots, \mathbf{6}_{mR}, \mathbf{6}_{mG}, \mathbf{6}_{mB}$ are opened, and all the scanning switches $\mathbf{5}_1, \ldots, \mathbf{5}_n$ and all the shunt switches $\mathbf{7}_{1R}, \mathbf{7}_{1G}, \mathbf{7}_{1B}, \ldots, \mathbf{7}_{mR}, \mathbf{7}_{mG}, \mathbf{7}_{mB}$ are switched over to the ground potential of 0 (V). The anode lines $A_{1R}, A_{1G}, A_{1B}, \ldots, A_{mR}, A_{mG}, A_{mB}$ and the cathode lines $B_1, \ldots, B_n$ are set to the ground potential of 0 (V), thus all being reset. By resetting all, all the anode lines and the cathode lines are made equal to the same potential of 0 (V), so that electric charge stored in each of the EL elements is discharged and thus the charged electric charge in all EL elements disappear instantly.

After the charged electric charge in all of the EL elements is zero, only the scanning switch $\mathbf{5}_2$ corresponding to the cathode line $B_2$ is then switched over to the 0 (V) side to carry out scanning over the cathode line $B_2$ as shown in FIG. 6. At the same time, the drive switches $\mathbf{6}_{2R}, \mathbf{6}_{2G}, \mathbf{6}_{2B}$ are closed to connect the current sources $\mathbf{2}_{2R}, \mathbf{2}_{2G}, \mathbf{2}_{2B}$ to the corresponding anode lines $A_{2R}, A_{2G}, A_{2B}$; and the shunt switches $\mathbf{7}_{1R}, \mathbf{7}_{1G}, \mathbf{7}_{1B}, \mathbf{7}_{3R}, \mathbf{7}_{3G}, \mathbf{7}_{3B}, \ldots, \mathbf{7}_{mR}, \mathbf{7}_{mG}, \mathbf{7}_{mB}$ are turned on to give 0 (V) to the anode lines $A_{1R}, A_{1G}, A_{1B}, A_{3R}, A_{3G}, A_{3B}, \ldots, A_{mR}, A_{mG}, A_{mB}$. Accordingly, in the case of FIG. 6, a voltage is applied to only the EL elements $E_{2R,2}, E_{2G,2}, E_{2B,2}$ in the forward direction, where drive currents flow in from the current sources $\mathbf{2}_{2R}, \mathbf{2}_{2G}, \mathbf{2}_{2B}$ to allow only the EL elements $E_{2R,2}, E_{2G,2}, E_{2B,2}$ to emit light.

The light emission control of the aforementioned reset drive method is to repeat the scan mode or a period for making any one of the cathode lines $B_1, \ldots, B_n$ active and the subsequent reset mode. The scan mode and the reset mode are carried out for every one horizontal scanning period (1H) of image data. Suppose that the state of FIG. 4 is directly transferred to that of FIG. 6 without carrying out the reset control. For example, the drive currents supplied from the current sources $\mathbf{2}_{2R}, \mathbf{2}_{2G}, \mathbf{2}_{2B}, \ldots, \mathbf{2}_{mR}, \mathbf{2}_{mG}, \mathbf{2}_{mB}$ not only flow into the EL elements $E_{2R,2}, E_{2G,2}, E_{2B,2}$ but also are dissipated to cancel out the electric charge stored in the reverse direction (shown in FIG. 4) in the EL elements $E_{2R,3}, \ldots, E_{2R,n}, E_{2G,3}, \ldots, E_{2G,n}, E_{2B,3}, \ldots, E_{2B,n}$. Consequently, it will take time to make the EL elements $E_{2R,2}, E_{2G,2}, E_{2B,2}$ emit light (to make the voltage across the EL elements $E_{2R,2}, E_{2G,2}, E_{2B,2}$ equal to the light emission regulating voltage Ve).

However, carrying out the aforementioned reset control allows the potential of the anode lines $A_{2R}, A_{2G}, A_{2B}$ to become generally Vcc at the instant of changing the scan to the cathode line $B_2$. Then, charge currents flow into the EL elements $E_{2R,2}, E_{2G,2}, E_{2B,2}$ which should be subsequently allowed to emit light, not only from the current sources $\mathbf{2}_{2R}$, $\mathbf{2}_{2G}$, $\mathbf{2}_{2B}$ but also through a plurality of routes from the constant voltage sources connected to the cathode lines $B_1$, $B_3, \ldots, B_n$ as shown in FIG. 6. These charge currents charge parasitic capacitances (the aforementioned capacitive components C) to allow the EL elements $E_{2R,2}, E_{2G,2}, E_{2B,2}$ to reach the light emission regulating voltage Ve and to be transferred to the state of light emission. After that, since within a scanning period of the cathode line $B_2$, as described above, the amount of current supplied from each of the current sources is restricted to an amount of current just enough for each of the EL elements to sustain the state of light emission at a light emission regulating voltage Ve, the currents supplied from the respective current sources $\mathbf{2}_{2R}$, $\mathbf{2}_{2G}$, $\mathbf{2}_{2B}$ flow into only the EL elements $E_{2R,2}, E_{2G,2}, E_{2B,2}$, all being dissipated for light emission, and the state of light emission shown in FIG. 6 is sustained.

As described above, according to the reset drive method, all the cathode lines and anode lines are once connected to either the ground potential of 0 (V) or the same potential of positive potential Vcc to reset the EL elements before the process proceeds to the light emission control of a subsequent scanning line. Accordingly, when the scan is changed over to the subsequent scanning line, it is possible to charge the EL elements quickly up to the light emission regulating voltage Ve and thus to provide EL elements which should emit light on the changed scanning line with a quick increase of light emission.

However, EL elements for red, green, and blue colors have element structures and materials, different from each other, so that the EL elements have the characteristics of voltage V—luminosity L, which are different from each other. Therefore, when all the EL elements constituting one pixel emit light to display white color, voltages applied to the both ends of each of the EL elements are different from each other. Thus, it is generally true that each of EL elements for red, green, and blue colors has a different light emission regulating voltage Ve. Therefore, when the reverse bias voltage Vcc is applied to each of the EL elements for red, green, and blue colors by the reset control as described above, and the cathode line for a subsequent scan is selected after the reset control, a difference in time will be produced until voltages across the EL elements, which should be allowed to emit light, on the cathode line selected reaches the light emission regulating voltage Ve of each of the red, green, and blue colors. Thus, since light emission at the light emission regulating voltage Ve did not take place at the same time, a problem of producing a difference in color was present.

SUMMARY OF THE INVENTION

It is therefore an object of the present invention to provide an apparatus and method for driving a multi-color light-emitting display panel, which can improve the rise characteristic of light emission of each of the capacitive light-emitting elements that have colors of light emission different from each other.

A drive apparatus for a multi-color light-emitting display panel according to the present invention, the multi-color light-emitting display panel including a plurality of drive lines and a plurality of scanning lines intersecting with each other, and a plurality of capacitive light-emitting elements having polarities connected to the scanning lines and the drive lines at a plurality of intersections of the drive lines and the scanning lines, and being divided into a plurality of types by a color of light emission, the capacitive light-emitting elements of the same color type being arranged on each of the plurality of drive lines, comprises scanning means for selectively supplying a first potential and a second potential higher than the first potential to each of the plurality of scanning lines; and drive means for selectively supplying a drive current from a current source and a third potential for an offset voltage, equal to or less than a light emission threshold voltage of the element to each of the plurality of drive lines, wherein the drive current and the third potential are variable.

According to the driving apparatus of the present invention, the drive current and the third potential are made variable. Variations in voltages across respective capacitive light-emitting elements for emitting light of colors different from each other can be thereby made equal to each other, the variations being produced by the time the voltages reach each desired voltage during a scanning period. Thus, the rise characteristic of each of the capacitive light-emitting elements that emit light of colors different from each other can be improved.

Furthermore, a method for driving a multi-color light-emitting display panel according to the present invention, multi-color light-emitting display panel including a plurality of drive lines and a plurality of scanning lines intersecting with each other, and a plurality of capacitive light-emitting elements having polarities connected to the scanning lines and the drive lines at a plurality of intersections of the drive lines and the scanning lines, and being divided into a plurality of types by a color of light emission, the capacitive light-emitting elements of the same color type being arranged on each of the plurality of drive lines, comprises the steps of repeatedly setting a scanning period to select one scanning line of the plurality of scanning lines and a subsequent reset period in accordance with a scan timing of input image data, designating at least one drive line of the plurality of drive lines corresponding to at least one capacitive light-emitting element which should be emitted light on the one scanning line during the scanning period in accordance with the input image data, supplying, during the scanning period, the first potential to the one scanning line and the second potential to scanning lines other than the one scanning line, and supplying, during the reset period, the first potential to all scanning lines, and supplying, during the scanning period, the drive current to the at least one drive line to apply a positive voltage equal to or greater than the light emission threshold voltage to the at least one capacitive light-emitting element in the forward direction, and supplying, during the reset period, the third potential to at least one subsequent drive line to be designated during a next scanning period to apply an offset voltage equal to or less than the light emission threshold voltage to at least one capacitive light-emitting element which should be allowed to emit light during the next scanning period, the drive current and the third potential being variable for each type of the capacitive light-emitting elements.

According to such a driving method of the present invention, a subsequent drive line corresponding to capacitive light-emitting elements which should be allowed to emit light during the subsequent scanning period is designated during a reset period in accordance with the input image data. In addition, the third potential is supplied to the subsequent drive line and thereby an offset voltage not greater than the light emission threshold voltage is applied to the capacitive light-emitting elements. Moreover, the drive current and the third potential are made variable depending on the type of the capacitive light-emitting elements. Consequently, variations in voltages across respective capacitive light-emitting elements for emitting light of colors different from each other can be thereby made equal to each other, the variations being produced by the time the voltages reach each desired voltage during a scanning period. Thus, the rise characteristic of each of capacitive light-emitting elements that emit light of colors different from each other can be improved.

BRIEF DESCRIPTION OF THE DRAWINGS

FIG. 17 is a view showing a data table;

FIGS. 18A–18C show the relationship between the offset voltage and reverse bias voltage of each of three primary colors;

FIG. 19 is a view showing the relationship between the offset voltage and reverse bias voltage when the luminosity of red is extremely decreased;

DETAILED DESCRIPTION OF THE PREFERRED EMBODIMENTS

The embodiments of the present invention will be explained below with reference to the drawings.

Figure 7:
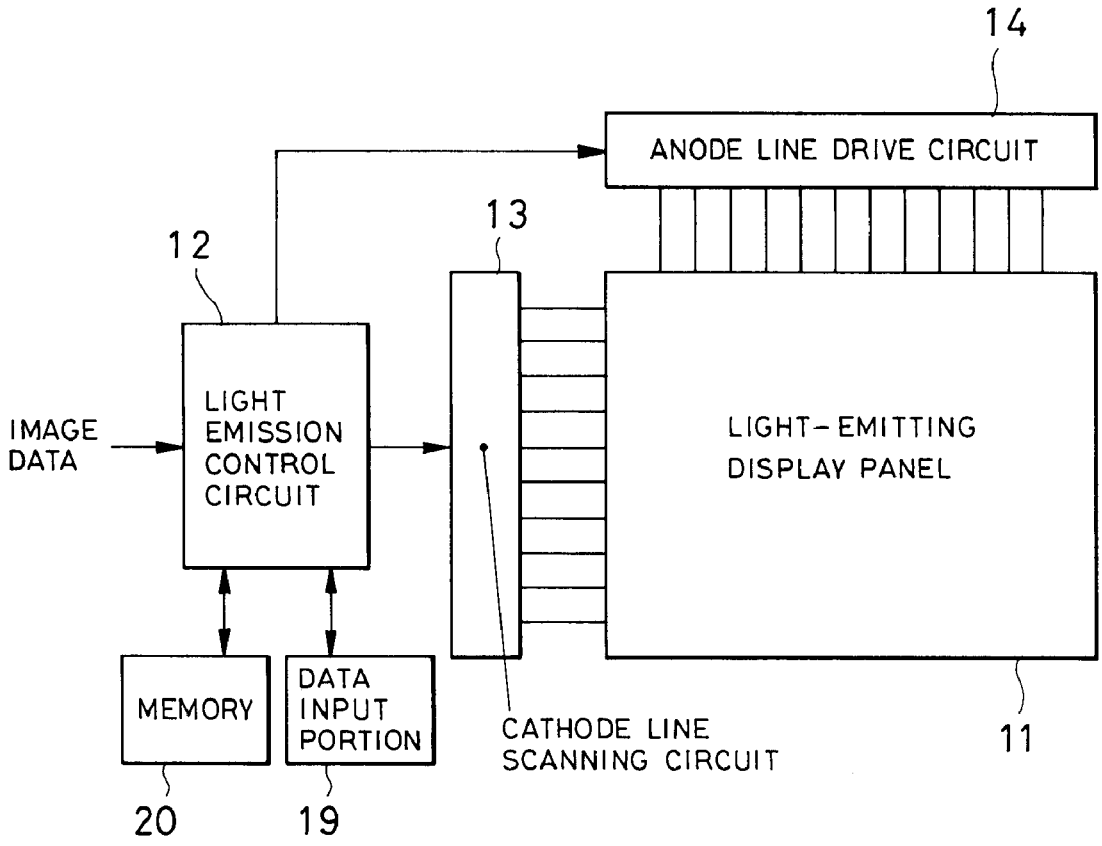
FIG. 7 is a schematic block diagram showing the configuration of a display apparatus to which the present invention is applied.

FIG. 7 shows a schematic configuration of a display device in which the present invention is applied to a multicolor light-emitting display panel employing EL elements as capacitive light-emitting elements. This display device has a capacitive light-emitting display panel 11, light emission control circuit 12, cathode line scanning circuit 13, and anode line drive circuit 14.

Figure 4:
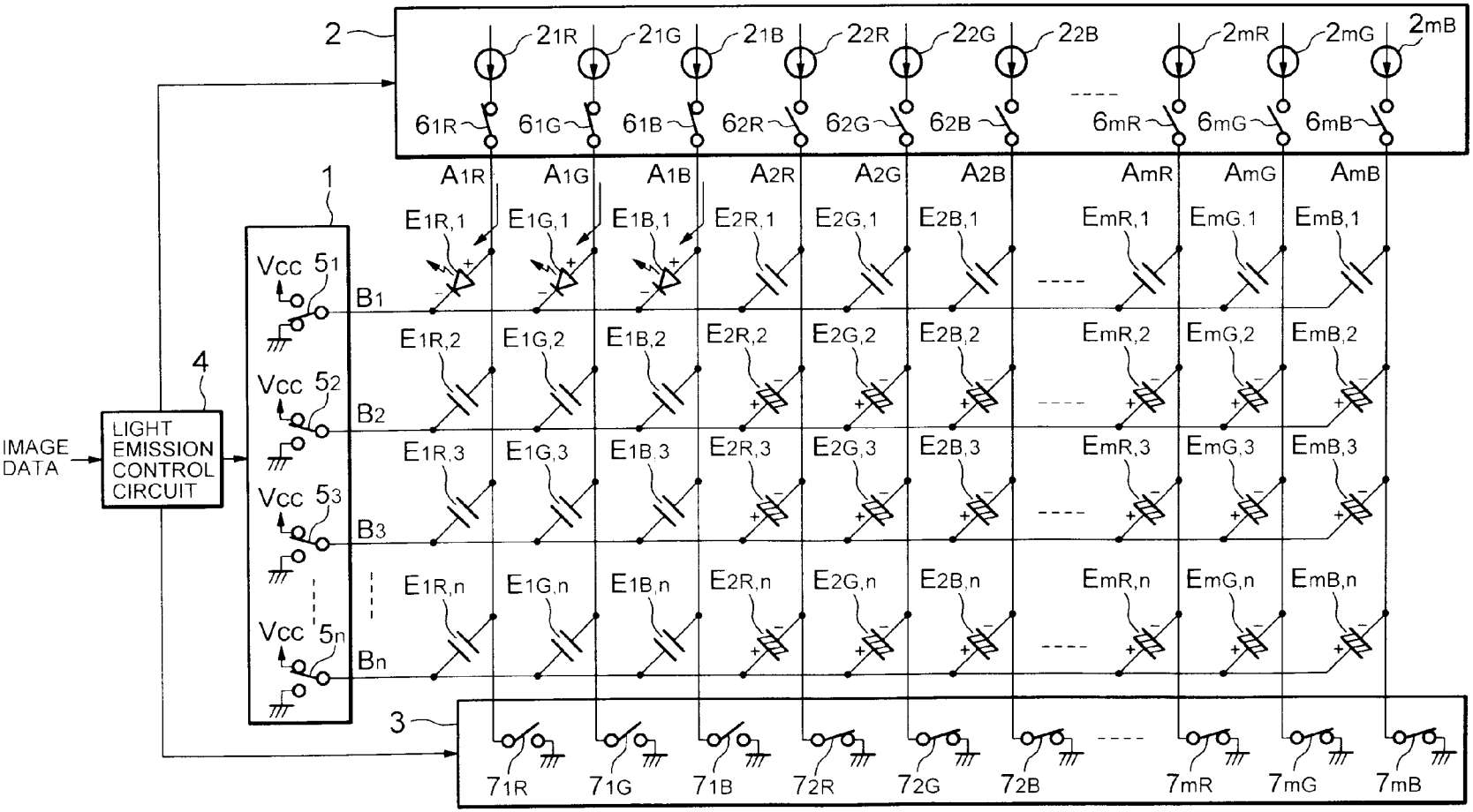
FIG. 4 is an explanatory block diagram showing the light emission control operation of a prior art drive apparatus.
Figure 5:
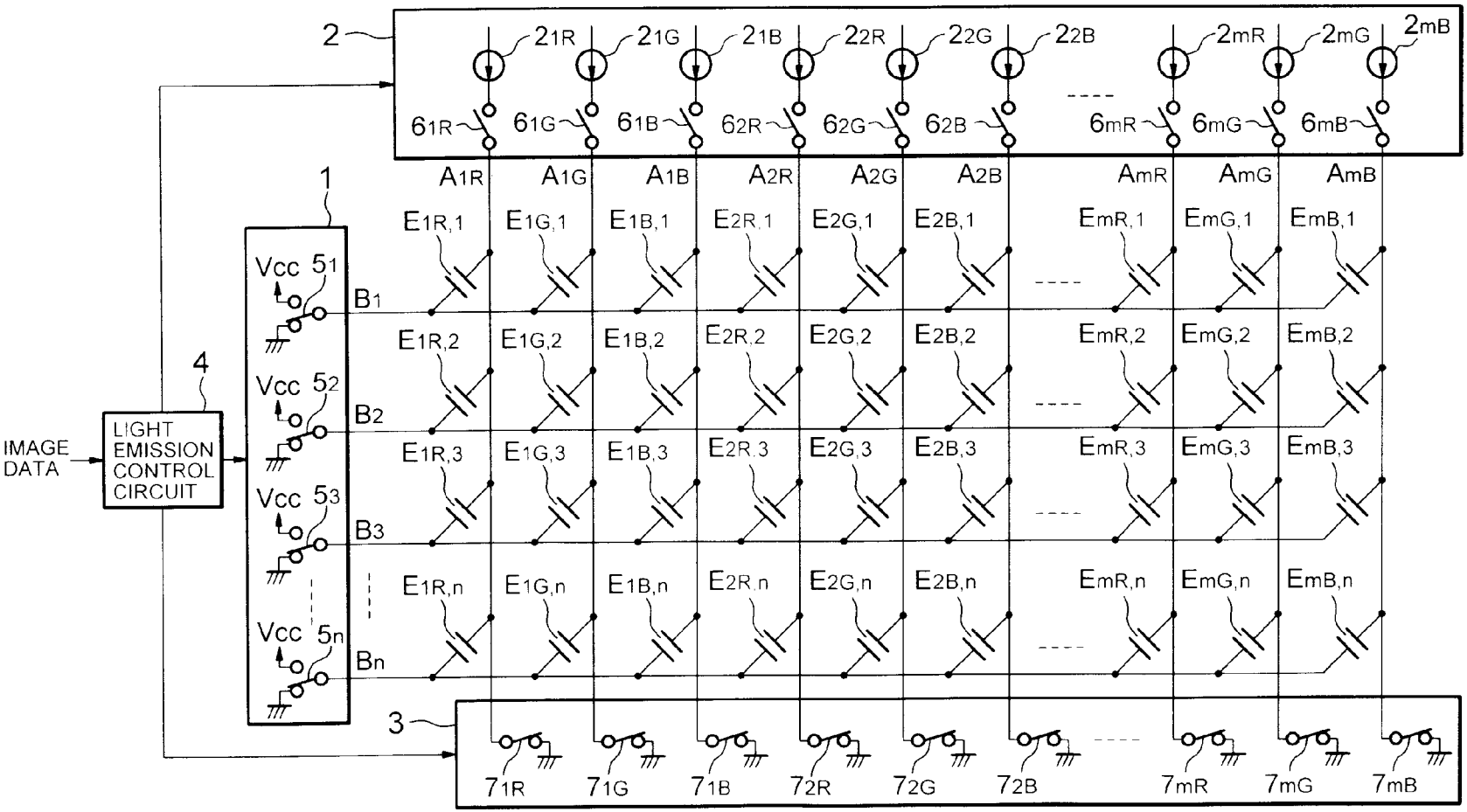
FIG. 5 is an explanatory block diagram showing the light emission control operation of the prior art drive apparatus.
Figure 6:
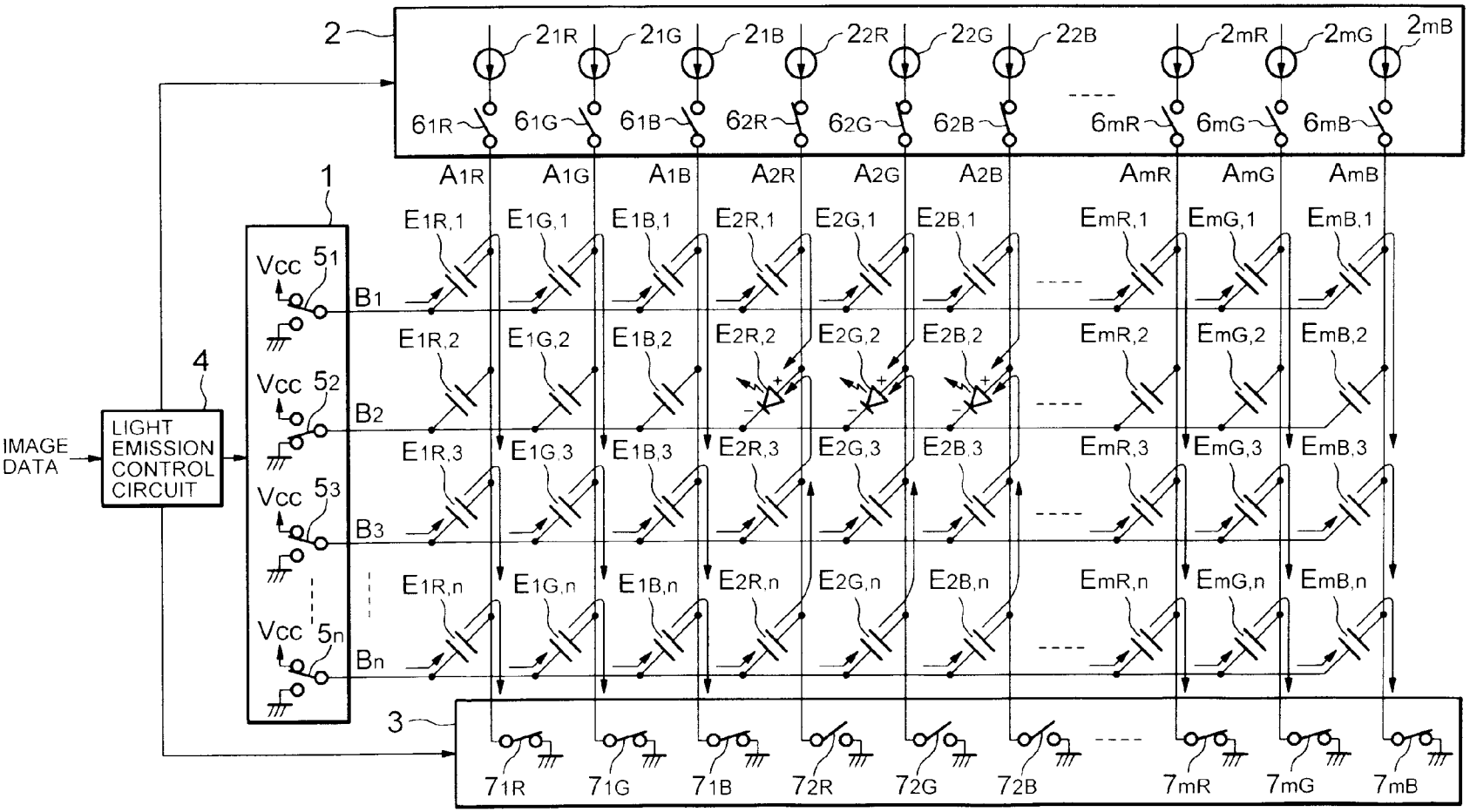
FIG. 6 is an explanatory block diagram showing the light emission control operation of the prior art drive apparatus.
Figure 8:
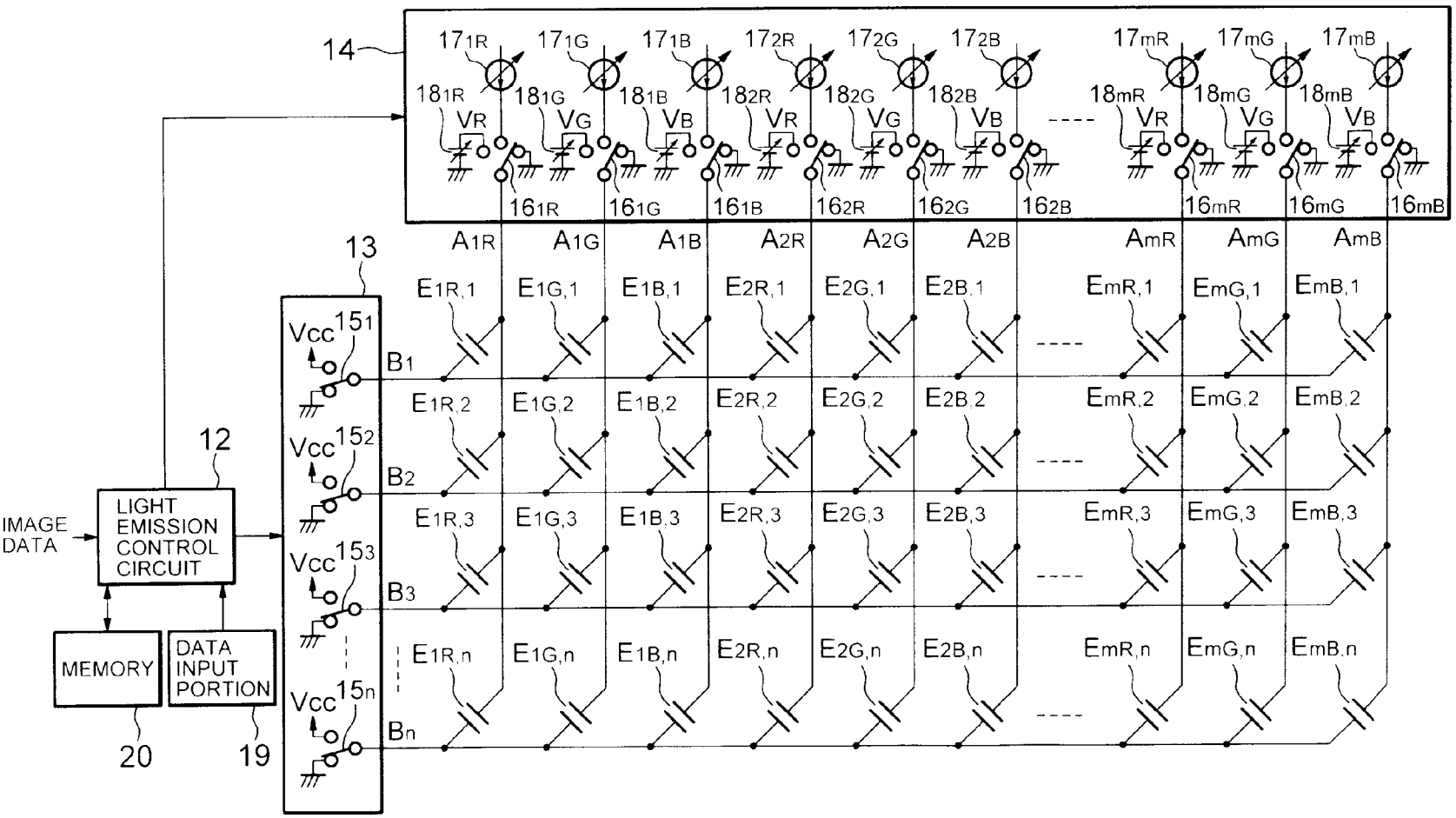
FIG. 8 is a view showing the specific configuration of the cathode line scanning circuits, the anode line drive circuits, and the light-emitting display panel of the apparatus of FIG. 7.

As shown in FIG. 8, the light-emitting display panel 11 is constructed in the same manner as those shown in FIGS. 4 to 6. That is, the light-emitting display panel 11 has a plurality of EL elements $E_{1R,1}$, $E_{1G,1}$, $E_{1B,1}$, . . . , $E_{mR,n}$, $E_{mG,n}$, $E_{mB,n}$ disposed at a plurality of intersections in a matrix of drive lines or anode lines $A_{1R}$, $A_{1G}$, $A_1$, . . . , $A_{mR}$, $A_{mG}$, $A_{mB}$ and scanning lines or cathode lines $B_1$–$B_n$. The EL elements $E_{1R,1}$, $E_{1G,1}$, $E_{1B,1}$, . . . , $E_{mR,n}$, $E_{mG,n}$, $E_{mB,n}$ are coupled to the anode lines and cathode lines at each of the plurality of intersections of the anode lines $A_{1R}$, $A_{1G}$, $A_{1B}$, . . . , $A_{mR}$, $A_{mG}$, $A_{mB}$ and the cathode lines $B_1$, . . . , $B_n$. The EL elements $E_{1R,1}$, . . . , $E_{mR,n}$ emit red light, the EL elements $E_{1G,1}$, . . . , $E_{mG,n}$ emit green light, and the EL elements $E_{1B,1}$, . . . , $E_{mB,n}$ emit blue light. Three EL elements of red (R), green (G), and blue (B) (for example, $E_{1R,1}$, $E_{1G,1}$, and $E_{1B,1}$) form one pixel at each of the cathode lines.

The cathode line scanning circuit 13 is coupled to the cathode lines $B_1$, . . . , $B_n$ of the display panel 11, while the anode line drive circuit 14 is coupled to the anode lines $A_{1R}$, $A_{1G}$, $A_{1B}$, . . . , $A_{mR}$, $A_{mG}$, $A_{mB}$. The cathode line scanning circuit 13 has scanning switches $\mathbf{15}_1$, . . . , $\mathbf{15}_n$ which are provided corresponding to the respective cathode lines $B_1$, . . . , $B_n$. Each of the scanning switches $\mathbf{15}_1$, . . . , $\mathbf{15}_n$ supplies either the ground potential or bias potential Vcc to a corresponding cathode line. The scanning switches $\mathbf{15}_1$, . . . , $\mathbf{15}_n$ are controlled by the light emission control circuit 12 so as to be switched over to the ground potential in sequence at every horizontal scanning period. Accordingly, the cathode lines $B_1$, . . . , $B_n$ which are set to the ground potential are to function as the scanning lines enabling the elements connected to the cathode lines to emit light.

The anode line drive circuit 14 has drive switches $\mathbf{16}_{1R}$, $\mathbf{16}_{1G}$, $\mathbf{16}_{1B}$, . . . , $\mathbf{16}_{mR}$, $\mathbf{16}_{mG}$, $\mathbf{16}_{mB}$, variable current sources $\mathbf{17}_{1R}$, $\mathbf{17}_{1G}$, $\mathbf{17}_{1B}$, . . . , $\mathbf{17}_{mR}$, $\mathbf{17}_{mG}$, $\mathbf{17}_{mB}$, and variable voltage sources $\mathbf{18}_{1R}$, $\mathbf{18}_{1G}$, $\mathbf{18}_{1B}$, . . . , $\mathbf{18}_{mR}$, $\mathbf{18}_{mG}$, $\mathbf{18}_{mB}$, which are provided corresponding to the respective anode lines $A_{1R}$, $A_{1G}$, $A_{1B}$, . . . , $A_{mR}$, $A_{mG}$, $A_{mB}$. Each of the drive switches $\mathbf{16}_{1R}$, . . . , $\mathbf{16}_{mR}$ supplies one of the current from the variable current sources $\mathbf{17}_{1R}$, $\mathbf{17}_{1G}$, $\mathbf{17}_{1B}$, . . . , $\mathbf{17}_{mR}$, $\mathbf{17}_{mG}$, $\mathbf{17}_{mB}$, the potential from the variable voltage sources $\mathbf{18}_{1R}$, $\mathbf{18}_{1G}$, $\mathbf{18}_{1B}$, . . . , $\mathbf{18}_{mR}$, $\mathbf{18}_{mG}$, $\mathbf{18}_{mB}$, and the ground potential to the corresponding anode line. The variable voltage sources $\mathbf{18}_{1R}$, . . . , $\mathbf{18}_{mR}$ output offset voltage $V_R$; the variable voltage sources $\mathbf{18}_{1G}$, . . . , $\mathbf{18}_{mG}$output offset voltage $V_G$; and the variable voltage sources $\mathbf{18}_{1B}$, . . . , $\mathbf{18}_{mB}$ output offset voltage $V_B$. The light emission control circuit 12 controls the current value of each of the variable current sources $17_{1R}$, $17_{1G}$, $17_{1B}$, . . . , $17_{mR}$, $17_{mG}$, $17_{mB}$ and the voltage value of each of the variable voltage sources $18_{1R}$, $18_{1G}$, $18_{1B}$, . . . , $18_{mR}$, $18_{mG}$, $18_{mB}$.

In accordance with pixel color information provided by image data, the light emission control circuit 12 generates a drive control signal (drive pulse) that shows which EL element connected to a scanning line is to be allowed to emit light, the timing for the light emission, and the duration of the light emission. Then, the light emission control circuit 12 supplies the drive control signal to the anode line drive circuit 14. In response to the drive control signal, the anode line drive circuit 14 switches those drive switches corresponding to the light emission among the drive switches $16_{1R}$, $16_{1G}$, $16_{1B}$, . . . , $16_{mR}$, $16_{mG}$, $16_{mB}$ to the current source side. Then, the anode line drive circuit 14 supplies drive currents $I_R$, $I_G$, $I_B$ to corresponding elements in response to the pixel information through corresponding anode lines (current addressing drive lines) among the anode lines $A_{1R}$, $A_{1G}$, $A_{1B}$, . . . , $A_{mR}$, $A_{mG}$, $A_{mB}$. In addition, the anode line drive circuit 14 supplies the ground potential to other anode lines via drive switches.

The light emission control circuit 12 is connected with a data input portion 19 and a memory 20. The data input portion 19 is adapted to be operable to control the luminosity of red, green, and blue colors of the light-emitting display panel 11. The data input portion 19 outputs, to the light emission control circuit 12, information regarding hue according to the user actuated position of a control lever (not shown) corresponding to each of the red, green, and blue colors, that is, luminosity data of each of the red, green, and blue colors. The memory 20 stores beforehand control data such as data tables, which are described later.

The light emission control operation of the light-emitting display panel 11 by means of the light emission control circuit 12 is explained with reference to the flow diagram of FIG. 9.

The light emission control circuit 12 carries out a light emission control routine every one horizontal scanning period of pixel data supplied. In the light emission control routine, first, pixel data within one horizontal scanning period is captured (step S1). Then, in accordance with the pixel information provided by the captured pixel data within one horizontal scanning period, a scan select control signal and a drive control signal is generated (step S2).

The scan select control signal is supplied to the cathode line scanning circuit 13. In order to set one of the cathode lines $B_1$, . . . , $B_n$, which corresponds to the current horizontal scanning period shown by the scan select control signal, to the ground potential, the cathode line scanning circuit 13 switches to the ground side the scanning switch corresponding to the one cathode line (one scanning switch $15_S$ among the switches $15_1$, . . . , $15_n$, where S is one of 1 to n). In order to apply positive potential Vcc to other cathode lines as the reverse bias potential, scanning switches (all the scanning switches of switches $15_1$, . . . , $15_n$ except the one scanning switch $15_1$) are switched over to the ground side.

The drive control signal is supplied to the anode line drive circuit 14. The anode line drive circuit 14 switches a drive switch (one of the drive switches $16_{1R}$, $16_{1G}$, $16_{1B}$, . . . , $16_{mR}$, $16_{mG}$, $16_{mB}$) corresponding to an anode line to a current source side (one of the current sources $17_{1R}$, $17_{1G}$, $17_{1B}$, . . . , $17_{mR}$, $17_{mG}$, $17_{mB}$ corresponding thereto), the anode line containing an element of the pixel, which should be driven to emit light, of the anode lines $A_{1R}$, $A_{1G}$, $A_{1B}$, . . . , $A_{mR}$, $A_{mG}$, $A_{mB}$ within the current horizontal scanning period shown by the drive control signal. Other anode lines are switched over to the ground side. For example, when the drive switches $16_{1R}$, $16_{1G}$, $16_{1B}$ are switched over to the current sources $17_{1R}$, $17_{1G}$, $17_{1B}$, a drive current $I_R$ flows from the current source $17_{1R}$ through the drive switch $16_{1R}$, the anode line $A_{1R}$, the element $E_{1R,S}$, the cathode line $B_S$, the scanning switch $15_S$ to the ground. On the other hand, a drive current $I_G$ flows from the current source $17_{1G}$ through the drive switch $16_{1G}$, the anode line $A_{1G}$, the element $E_{1G,S}$, the cathode line $B_S$, the scanning switch $15_S$ to the ground. Moreover, a drive current $I_B$ flows from the current source $17_{1B}$ through the drive switch $16_{1B}$, the anode line $A_{1B}$, the element $E_{1B,S}$, the cathode line $B_S$, the scanning switch $15_S$ to the ground. The EL elements $E_{1R,S}$, $E_{1G,S}$, $E_{1B,S}$, to which are the drive currents $I_R$, $I_G$, $I_B$ are supplied, emit light according to the corresponding pixel information. The time for light emission in each of the EL elements $E_{1R,S}$, $E_{1G,S}$, $E_{1B,S}$ is set individually in accordance with information regarding pixel colors, thereby allowing a pixel comprising the EL elements $E_{1R,S}$, $E_{1G,S}$, $E_{1B,S}$ to be displayed in a desired color.

The light emission control circuit 12 determines whether a predetermined time has elapsed after the execution of step S2 (step S3). The predetermined time is set corresponding to a predetermined horizontal scanning period. If the predetermined time has elapsed, the light emission control circuit 12 generates a reset signal (step S4). The reset signal is supplied to the cathode line scanning circuit 13 and the anode line drive circuit 14. The cathode line scanning circuit 13 switches the movable contacts of all the scanning switches $15_1$, . . . , $15_n$ to the stationary contacts on the ground side in response to the reset signal. The reset signal shows the designation of the anode lines (subsequent drive lines) corresponding to the EL elements that should be driven to emit light during the subsequent scanning period. The anode line drive circuit 14 switches the movable contacts of the drive switches, which are coupled to the anode lines corresponding to the EL elements that should be driven to emit light during the subsequent scanning period, to the stationary contacts on the offset voltage side in response to the reset signal. This causes an offset voltage to be applied to the EL elements that should be driven to emit light during the subsequent scanning period. That is, the offset voltage $V_R$ is applied to the EL element for emitting red light that should be driven to emit light during the subsequent scanning period; the offset voltage $V_G$ is applied to the EL element for emitting green light; and the offset voltage $V_B$ is applied to the EL element for emitting blue light. This will cause the capacitive component of each of the EL elements to be charged, which should be driven to emit light during the subsequent scanning period.

After having completed the execution of step S4, the light emission control circuit 12 completes the light emission control routine and will be on standby until the subsequent horizontal scanning period starts. Even during the time until the subsequent horizontal scanning period is started, the reset operation of step S4 is continued. When the subsequent horizontal scanning period starts, the aforementioned operations in step S1 to S4 are repeated.

Figure 10:
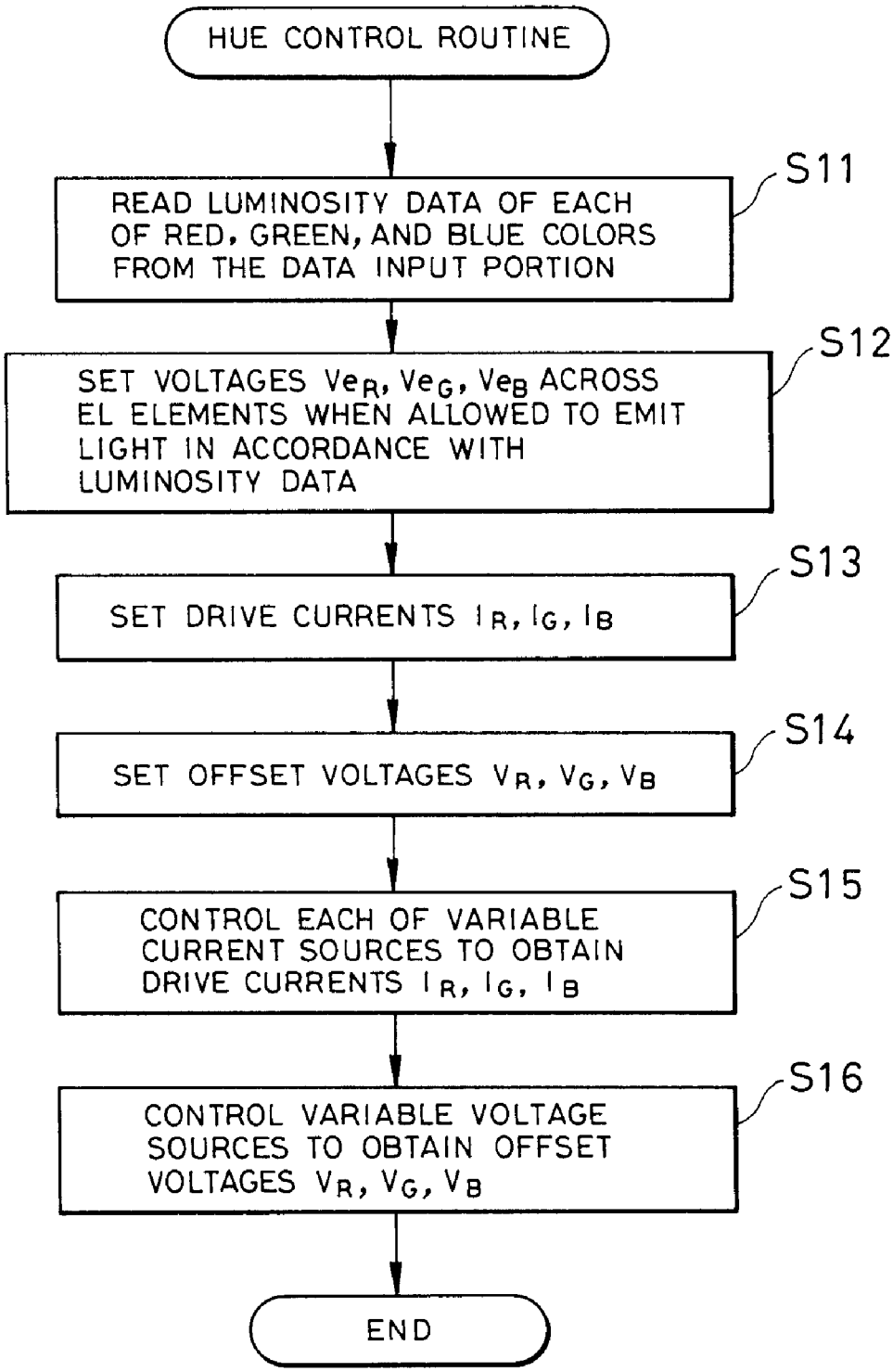
FIG. 10 is a flow diagram showing a hue control routine.

Next, the hue control operation by means of the light emission control circuit 12 is explained with reference to the flow diagram of FIG. 10.

Figure 3:
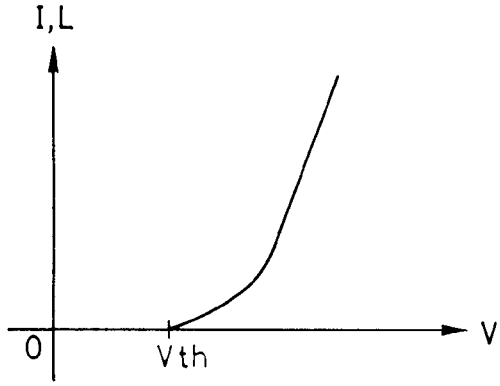
FIG. 3 is a schematic plot showing the drive voltage current light-emitting luminosity characteristic of an organic electroluminescence element.

The light emission control circuit 12 carries out the hue control routine in response to the luminosity data of each of red, green, and blue colors at the time when the user actuates the control lever of the data input portion 19. In the hue control routine, first, the luminosity data of each of red, green, and blue colors, which is outputted from the data input portion 19 is read (step S11). Then, voltages $Ve_R$, $Ve_G$, $Ve_B$, corresponding to the luminosity data of each of red, green, and blue colors and appearing at the time of light emission across each of the red, green, and blue EL elements are set (step S12). The memory 20 stores as a data table in FIG. 17, for example, the characteristic of voltage V—Current I—luminosity L, like the one which is shown in FIG. 3, for every red, green, and blue color. Accordingly, this table can be used to determine the voltages $Ve_R$, $Ve_G$, $Ve_B$, corresponding to the luminosity data of each of red, green, and blue colors and appearing at the time of light emission across each of the red, green, and blue EL elements. The luminosity data is shown in 32 levels of halftone.

After having carried out step S12, the light emission control circuit 12 sets drive currents $I_R$, $I_G$, $I_B$ according to the voltages $Ve_R$, $Ve_G$, $Ve_B$, appearing at the time of light emission across the elements (step S13). Moreover, the light emission control circuit 12 sets the offset voltages $V_R$, $V_G$, $V_B$, corresponding to the voltages $Ve_R$, $Ve_G$, $Ve_B$ across the elements (step S14). The drive currents $I_R$, $I_G$, $I_B$ can be set corresponding to the luminosity data of each of the red, green, and blue colors, using the aforementioned data table of the characteristic of voltage V—Current I—luminosity L of each EL element for emitting red, green, and blue light. Each of the offset voltages is calculated and set, so that the offset voltage $V_R=Ve_R-Vcc$; the offset voltage $V_B=Ve_B-Vcc$; and the offset voltage $V_B=Ve_B$—Vcc. At each of EL elements for emitting red, green, and blue light, it holds true in order to prevent cross-talk light emission that $V_R<Vth_R$, $V_G<Vth_G$, and $V_B<Vth_B$, where the light emission threshold voltages are $Vth_R$, $Vth_G$, and $Vth_B$.

The light emission control circuit 12 controls the variable current sources $\mathbf{17}_{1R}$, $\mathbf{17}_{1G}$, $\mathbf{17}_{1B}$, . . . , $\mathbf{17}_{mR}$, $\mathbf{17}_{mG}$, $\mathbf{17}_{mB}$ so as to obtain the drive currents $I_R$, $I_G$, $I_B$ which have been set (step S15). In addition, the light emission control circuit 12 controls the output voltage of the variable voltage sources $\mathbf{18}_{1R}$, $\mathbf{18}_{1G}$, $\mathbf{18}_{1B}$, . . . , $\mathbf{18}_{mR}$, $\mathbf{18}_{mG}$, $\mathbf{18}_{mB}$ so as to obtain the offset voltages $V_R$, $V_G$, $V_B$, which have been set (step S16). That is, the supply current by means of the variable current sources $\mathbf{17}_{1R}$, . . . , $\mathbf{17}_{mR}$ is made equal to the drive current $I_R$ that has been set in step S13. On the other hand, the supply current by means of the variable current sources $\mathbf{17}_{1G}$, . . . , $\mathbf{17}_{mG}$ is made equal to the drive current $I_G$ that has been set in step S13, and the supply current by means of the variable current sources $\mathbf{17}_{1B}$, . . . , $\mathbf{17}_{mB}$ is made equal to the drive current $I_B$ that has been set in step S13. The output voltage of the variable voltage sources $\mathbf{18}_{1R}$, . . . , $\mathbf{18}_{mR}$ is made equal to the offset voltage $V_R$ that has been set in step S14. On the other hand, the output voltage of the variable voltage sources $\mathbf{18}_{1G}$, . . . , $\mathbf{18}_{mG}$ is made equal to the offset voltage $V_G$ that has been set in step S14, and the output voltage of the variable voltage sources $\mathbf{18}_{1G}$, . . . , $\mathbf{18}_{mG}$ is made equal to the offset voltage $V_B$ that has been set in step S14.

Each of the EL elements for emitting red, green, and blue light has the characteristic of voltage V—Current I—luminosity L of EL elements, shown in FIG. 3, different from each other. Accordingly, in the aforementioned data table, data such as the voltage across an EL element, a drive current, and an offset voltage, corresponding to the luminosity data of the red, green, and blue colors are determined.

Figure 12:
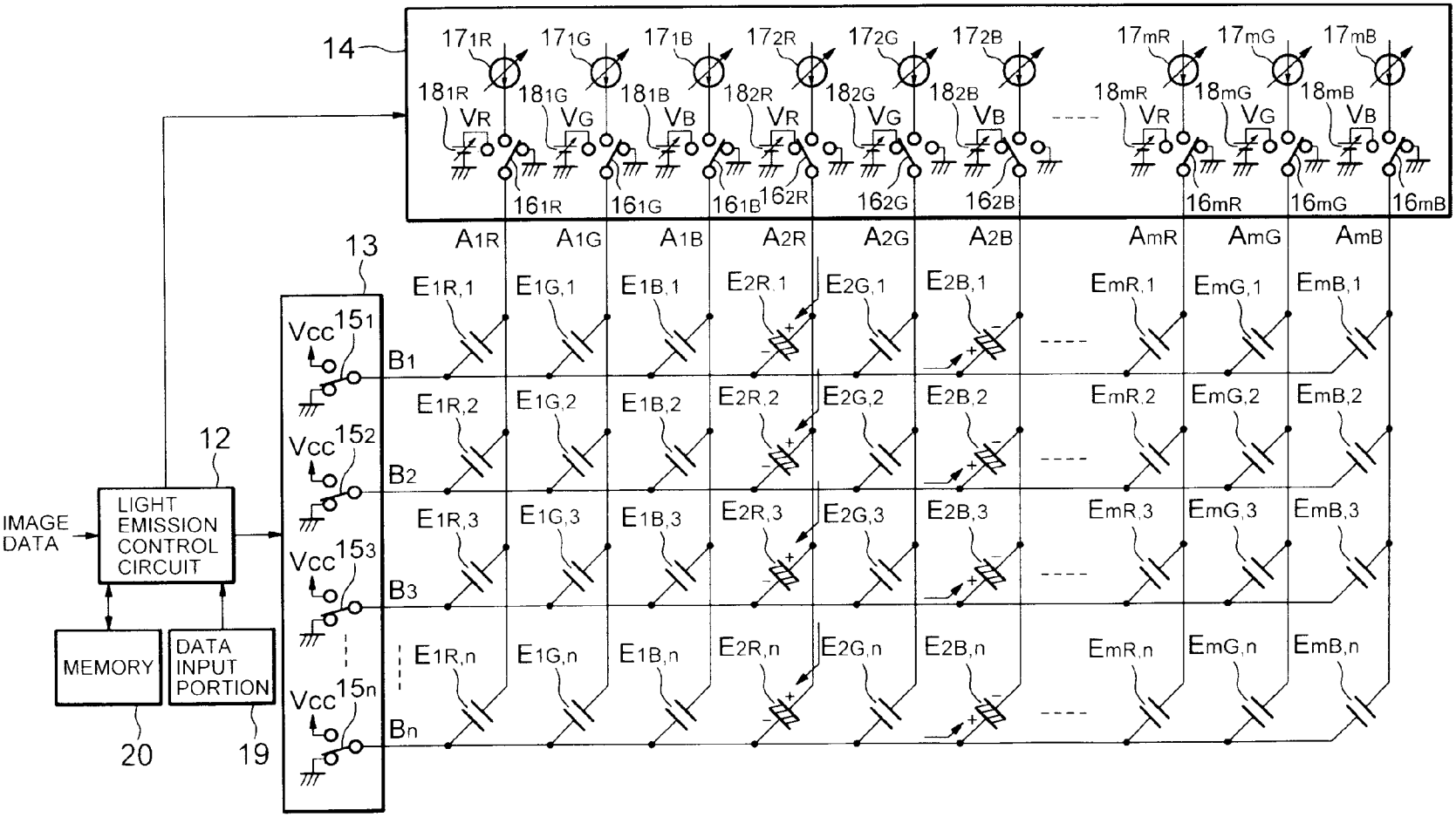
FIG. 12 is an explanatory block diagram showing the light emission control operation during a reset period.
Figure 13:
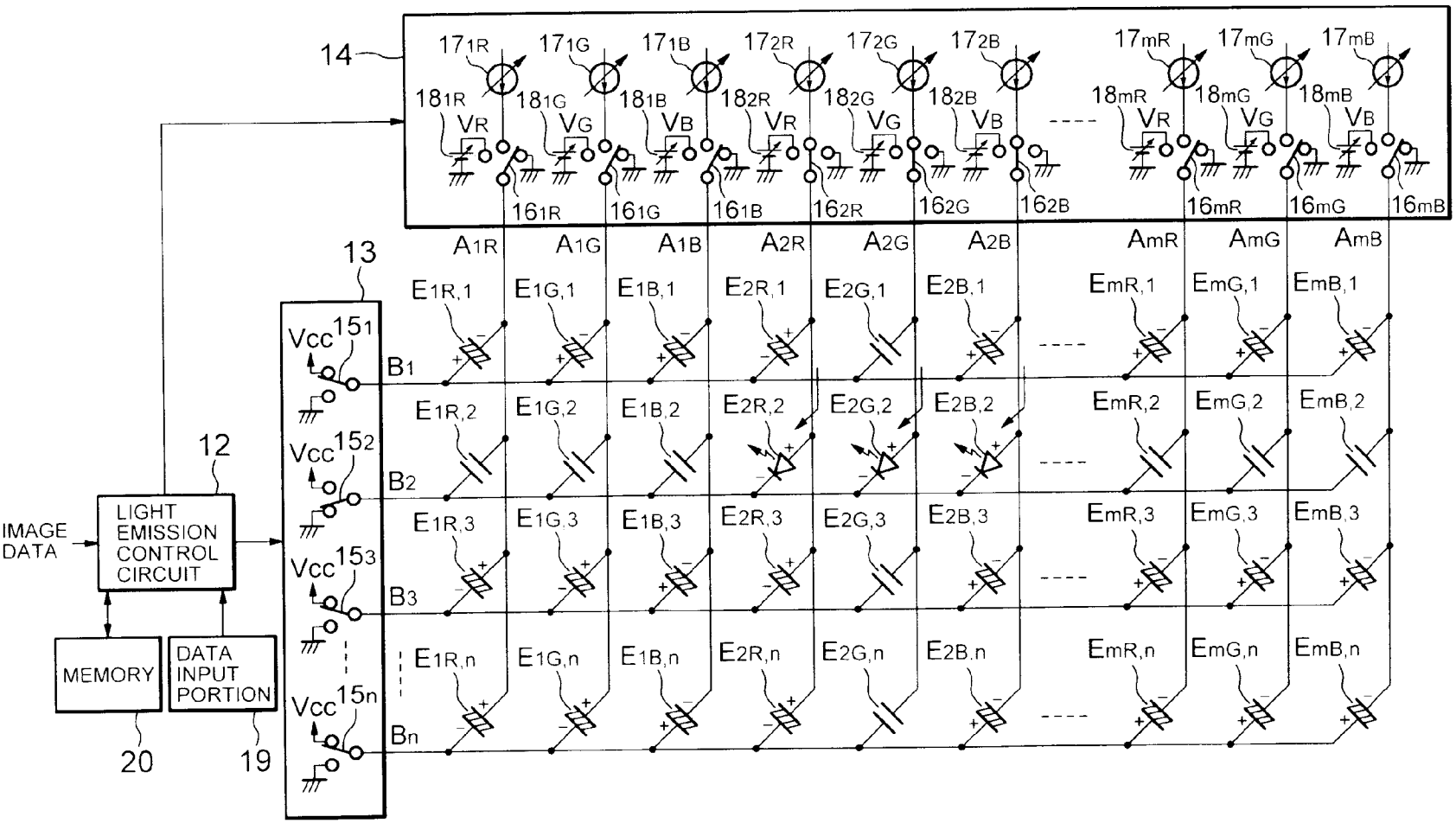
FIG. 13 is an explanatory block diagram showing the light emission control operation during the subsequent scanning period.

Next, such a case is explained with reference to FIGS. 11 to 13 as the cathode line $B_1$ is scanned by the light emission control operation of the light emission control circuit 12 to allow EL elements $E_{1R,1}$, $E_{1G,1}$, $E_{1B,1}$ of a pixel to emit light and thereafter the scan is transferred to the cathode line $B_2$ to cause EL elements $E_{2R,2}$, $E_{2G,2}$, $E_{2B,2}$ of a pixel to emit light. For the sake of clarity in explanation, like FIGS. 3 and 5, FIGS. 11 to 13 show elements that are emitting light by diode symbols, while elements that are not emitting light are expressed with capacitor symbols.

Figure 11:
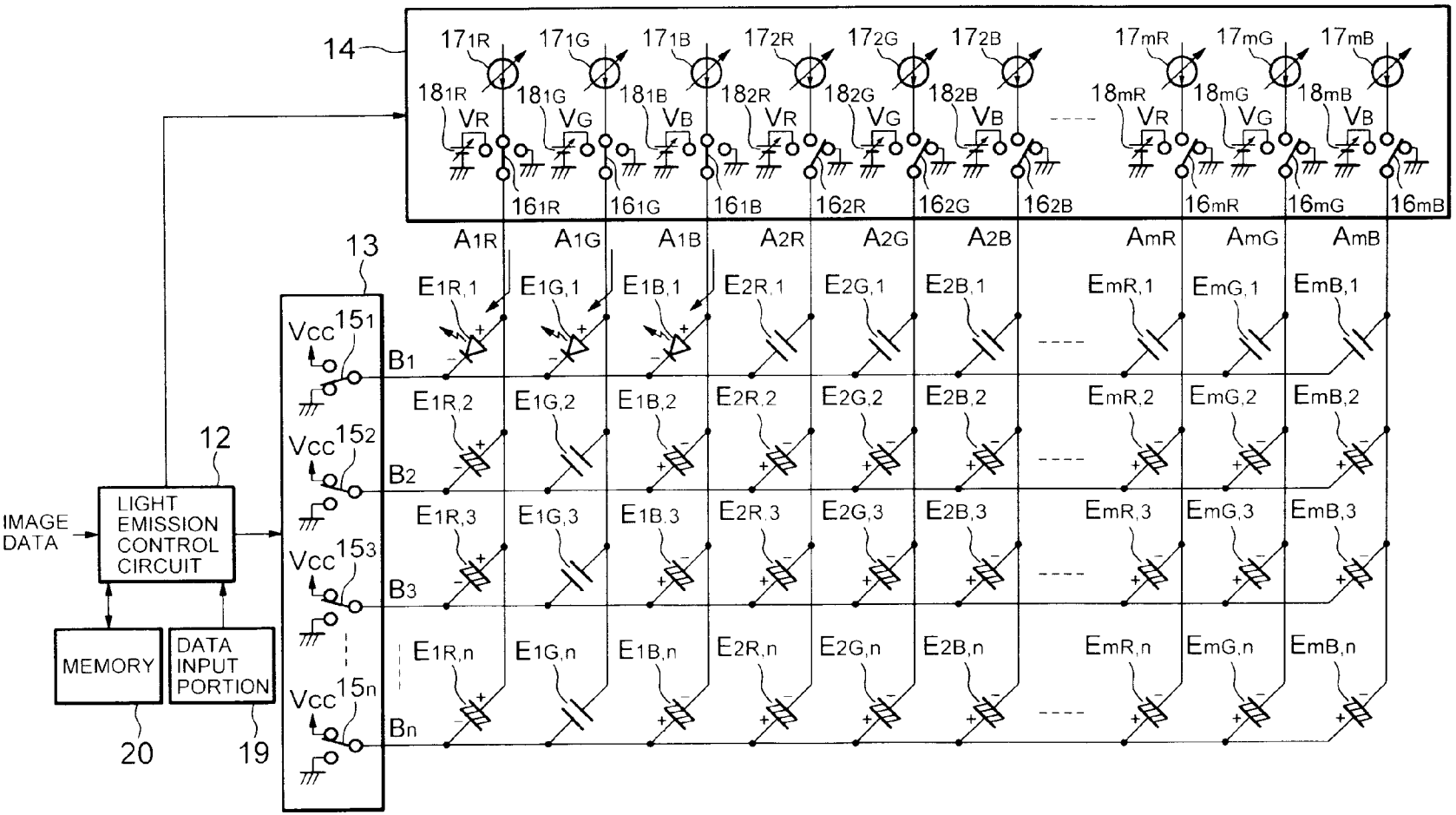
FIG. 11 is an explanatory block diagram showing the light emission control operation during a scanning period.

First, FIG. 11 shows an operating state in which the elements $E_{1R,1}$, $E_{1G,1}$, $E_{1B,1}$ that should emit light are emitting light under the steady light-emitting state within a scanning period during which the cathode line $B_1$ is being selectively scanned with only the scanning switch $\mathbf{15}_1$ being switched over to the ground potential side of 0 (V). The positive potential Vcc is applied to other cathode lines $B_2$, . . . , $B_n$ by means of the scanning switches $\mathbf{15}_2$, . . . , $\mathbf{15}_n$. At the same time, the anode lines $A_{1R}$, $A_{1G}$, $A_{1B}$ are connected with the variable current sources $\mathbf{17}_{1R}$, $\mathbf{17}_{1G}$, $\mathbf{17}_{1B}$ by means of the drive switches $\mathbf{16}_{1R}$, $\mathbf{16}_{1G}$, $\mathbf{16}_{1B}$. In addition, other anode lines $A_{2R}$, $A_{2G}$, $A_{2B}$, . . . , $A_{mR}$, $A_{mG}$, $A_{mB}$are switched over to the ground potential side of 0 (V) by means of the drive switches $\mathbf{16}_{2R}$, $\mathbf{16}_{2G}$, $\mathbf{16}_{2B}$, . . . , $\mathbf{16}_{mR}$, $\mathbf{16}_{mG}$, $\mathbf{16}_{mB}$. Therefore, in the case of FIG. 11, a forward voltage is applied only to the EL elements $E_{1R,1}$, $E_{1G,1}$, $E_{1B,1}$, so that the drive currents $I_R$, $I_G$, $I_B$ flow in from the variable current sources $\mathbf{17}_{1R}$, $\mathbf{17}_{1G}$, $\mathbf{17}_{1B}$ to cause only the EL elements $E_{1R,1}$, $E_{1G,1}$, $E_{1B,1}$ to emit light.

In this state, the voltage Vcc is applied across the terminal of each of the non-light-emitting EL elements $E_{2R,2}$, $E_{2G,2}$, $E_{2B,2}$, . . . , $E_{mR,n}$, $E_{mG,n}$, $E_{mB,n}$, which are shown by being shaded, the capacitive components thereof are to be charged opposite to the forward direction shown in the drawing. Moreover, the anode line $A_{1R}$ to which the EL elements $E_{1R,2}$, . . . , $E_{1R,n}$ of the non-light-emitting EL elements $E_{1R,2}$, $E_{1G,2}$, $E_{1B,2}$, . . . , $E_{1R,n}$, $E_{1G,n}$, $E_{1B,n}$ are coupled has a voltage $Ve_R$, and the voltage Vcc is applied to the cathode lines $B_2$, . . . , $B_n$ of the EL elements $E_{1R,2}$, . . . , $E_{1R,n}$. Therefore, a voltage, $Ve_R-Vcc$, is applied to the EL elements $E_{1R,2}$, . . . , $E_{1R,n}$ in the forward direction, and the capacitive components thereof are charged. The anode line $A_{1G}$ to which the EL elements $E_{1G,2}$, . . . , $E_{1G,n}$ are coupled has a voltage $Ve_G$, and the voltage Vcc is applied to the cathode lines $B_2$, . . . , $B_n$ of the EL elements $E_{1G,2}$, . . . , $E_{1G,n}$. Therefore, a voltage, $Ve_G-Vcc=0$, is applied to the EL elements $E_{1G,2}$, . . . , $E_{1G,n}$, and the capacitive components thereof are not charged. The anode line $A_{1B}$ to which the EL elements $E_{1B,2}$, . . . , $E_{1B,n}$ are coupled has a voltage $Ve_B$, and the voltage Vcc is applied to the cathode lines $B_2$, . . . , $B_n$ of the EL elements $E_{1B,2}$, . . . , $E_{1B,n}$. Therefore, a voltage, $Vcc-Ve_G$, is applied to the EL elements $E_{1B,2}$, . . . , $E_{1B,n}$ in the reverse direction, and the capacitive components thereof are charged.

Immediately before the scan is transferred from the light-emitting state of FIG. 11 to the state where the subsequent EL elements $E_{2R,2}$, $E_{2G,2}$, $E_{2B,2}$ emit light, a reset period comes 5during which the aforementioned step S4 performs reset control. That is, as shown in FIG. 12, the drive switches $\mathbf{16}_{1R}$, $\mathbf{16}_{1G}$, $\mathbf{16}_{1B}$, and $\mathbf{16}_{3R}$, $\mathbf{16}_{3G}$, $\mathbf{16}_{3B}$, . . . , $\mathbf{16}_{mR}$, $\mathbf{16}_{mG}$, $\mathbf{16}_{mB}$, other than the drive switches $\mathbf{16}_{2R}$, $\mathbf{16}_{2G}$, $\mathbf{16}_{2B}$ corresponding to the EL elements $E_{2R,2}$, $E_{2G,2}$, $E_{2B,2}$, are switched over to the ground potential side. In addition, all scanning switches $\mathbf{15}_1$, . . . , $\mathbf{15}_n$ are switched over to the ground potential side, and the anode lines $A_{1R}$, $A_{1G}$, $A_{1B}$, $A_{3R}$, $A_{3G}$, $A_{3B}$, . . . , $A_{mR}$, $A_{mG}$, $A_{mB}$ and the cathode lines $B_1$, . . . , $B_n$ are once made equal to the ground potential side of 0 (V). This resets the EL elements $E_{1R,1}$, . . . , $E_{1R,n}$, $E_{1G,1}$, . . . , $E_{1G,n}$, $E_{1B,1}$, . . . , $E_{1B,n}$, $E_{3R,1}$, $E_{3G,1}$, $E_{3B,1}$, . . . , $E_{mR,n}$, $E_{mG,n}$, $E_{mB,n}$, and an equal voltage of 0 (V) appears between the anode and cathode of the EL elements.

Accordingly, the electric charge that has been charged in each of the EL elements is discharged, and thus the charged electric charge in all the EL elements are discharged instantly, so that no charge is left therein. An equal potential of 0 (V) also appears between the anode and the cathode of the EL elements $E_{1G,2}, \ldots, E_{1G,n}$, however, no discharge occurs since the EL elements $E_{1G,2}, \ldots, E_{1G,n}$ have not been charged when the EL elements $E_{1R,1}, E_{1G,1}, E_{1B,1}$ emit light, and thus no charge is stored.

The reset control causes the drive switches $\mathbf{16}_{2R}$, $\mathbf{16}_{2G}$, $\mathbf{16}_{2B}$ to be switched over to the side of the variable voltage sources $\mathbf{18}_{2R}$, $\mathbf{18}_{2G}$, $\mathbf{18}_{2B}$. Accordingly, the positive voltage $V_R$ of the variable voltage source $\mathbf{18}_{2R}$ is applied to the anode of each of the EL elements $E_{2R,1}, \ldots, E_{2R,n}$ for emitting red light via the drive switch $\mathbf{16}_{2R}$ and the anode line $A_{2R}$. The positive voltage $V_G$ of the variable voltage source $\mathbf{18}_{2G}$ is applied to the anode of each of the EL elements $E_{2G,1}, \ldots, E_{2G,n}$ for emitting green light via the drive switch $\mathbf{16}_{2G}$ and the anode line $A_{2G}$. Moreover, the positive voltage $V_B$ of the variable voltage source $\mathbf{18}_{2B}$ is applied to the anode of each of the EL elements $E_{2B,1}, \ldots, E_{2B,n}$ for emitting red light via the drive switch $\mathbf{16}_{2B}$ and the anode line $A_{2B}$. The cathode of each of the EL elements $E_{2R,1}, E_{2G,1}, E_{2B,1}, \ldots, E_{2R,n}, E_{2G,n}, E_{2B,n}$ is maintained at the ground potential via the corresponding scanning switches $\mathbf{15}_1, \ldots, \mathbf{15}_n$. Accordingly, the offset voltage $V_R$ is applied across the anode and the cathode of the EL elements $E_{2R,1}, \ldots, E_{2R,n}$ for emitting red light. In addition, the offset voltage $V_G$ is applied to across the anode and the cathode of the EL elements $E_{2G,1}, \ldots, E_{2G,n}$ for emitting green light, while the offset voltage $V_B$ is applied to across the anode and the cathode of the EL elements $E_{2B,1}, \ldots, E_{2B,n}$ for emitting blue light. Here, if it holds true for the initial values of the offset voltages $V_R$, $V_G$, $V_B$, that $V_R>0$ (V), $V_G=0$ (V), and $V_B<0$ (V), the capacitive components of the EL elements $E_{2R,1}, \ldots, E_{2R,n}$ for emitting red light are charged in the forward direction, while the capacitive components of the EL elements $E_{2G,1}, \ldots, E_{2G,n}$ for emitting green light are not charged and the capacitive components of the EL elements $E_{2B,1}, \ldots, E_{2B,n}$ for emitting blue light are charged opposite to the forward direction, as shown in FIG. 11.

The stored charge of all the EL elements $E_{1R,1}, E_{1G,1}, E_{1B,1}, \ldots, E_{1R,n}, E_{1G,n}, E_{1B,n}, E_{3R,1}, E_{3G,1}, E_{3B\,1}, \ldots, E_{mR,n}, E_{mG,n}, E_{mB,n}$ is made zero, and the voltage across each of the EL elements $E_{2R,1}, E_{2G,1}, E_{2B\,1}, \ldots, E_{2R,n}, E_{2G,n}, E_{2B,n}$ is made equal to the offset voltages $V_R$, $V_G$, $V_B$. Thereafter, the subsequent scanning period comes now. As shown in FIG. 13, only the scanning switch $\mathbf{15}_2$ corresponding to the cathode line $B_2$ is switched over to the ground potential side and the cathode line $B_2$ is selectively scanned. At the same time, the drive switches $\mathbf{16}_{2R}$, $\mathbf{16}_{2G}$, $\mathbf{16}_{2B}$ are switched over to the variable current source side to allow the variable current sources $\mathbf{17}_{2R}$, $\mathbf{17}_{2G}$, $\mathbf{17}_{2B}$ to be connected to the corresponding anode lines $A_{2R}$, $A_{2G}$, $A_{2B}$.

At the moment the scanning switches and the drive switches are switched over, that is, at the moment the scanning switches and the drive switches are switched over as shown in FIG. 13 and the charged state of the parasitic capacitance of each EL element remains as in the state of FIG. 12, the potential of the anode line $A_{2R}$ is generally equal to $Vcc+V_R$ (precisely speaking, equal to $(n-1)\cdot(Vcc+V_R)/n$). Accordingly, the voltage across the EL element $E_{2R,2}$ that is allowed to emit light is to take instantly on approximately $Vcc+V_R$. Therefore, charge currents quickly charge the EL element $E_{2R,2}$ by flowing therein from a plurality of routes such as the route from the scanning switch $\mathbf{15}_1$ through the cathode line $B_1$, the EL element $E_{2R,1}$, the anode line $A_{2R}$, and the EL element $E_{2R,2}$ to the scanning switch $\mathbf{15}_2$; the route from the scanning switch $\mathbf{15}_3$ through the cathode line $B_3$, the EL element $E_{2R,3}$, the anode line $A_{2R}$, and the EL element $E_{2R,2}$ to the scanning switch $\mathbf{15}_2$; . . . ; and the route from the scanning switch $\mathbf{15}_n$ through the cathode line $B_n$ the EL element $E_{2R,n}$, the anode line $A_{2R}$ and the EL element $E_{2R,2}$ to the scanning switch $\mathbf{15}_2$, in addition to the route from the variable current source $\mathbf{17}_{2R}$ through the drive switch $\mathbf{16}_{2R}$, the anode line $A_{2R}$, and the EL element $E_{2R,2}$ to the scanning switch $\mathbf{15}_2$. Consequently, this causes the EL element $E_{2R,2}$ to go into the steady light-emitting state instantly. Thereafter, during the scanning period of $B_2$, the steady light-emitting state is sustained by a drive current flowing in via the route from the variable current source $\mathbf{17}_{2R}$ through the drive switch $\mathbf{16}_{2R}$, the anode line $A_{2R}$, and the EL element $E_{2R,2}$ to the scanning switch $\mathbf{15}_2$.

Likewise, at the moment the scanning switches and the drive switches are switched over, the voltage across the EL element $E_{2G,2}$ starts becoming approximately Vcc (precisely speaking, equal to $(n-1)\cdot Vcc/n$). Therefore, charge currents drive the EL element $E_{2G,2}$ into the steady light-emitting state instantly by flowing therein from a plurality of routes such as the route from the scanning switch $\mathbf{15}_1$ through the cathode line $B_1$, the EL element $E_{2G,1}$, the anode line $A_{2G}$, and the EL element $E_{2G,2}$ to the scanning switch $\mathbf{15}_2$; the route from the scanning switch $\mathbf{15}_3$ through the cathode line $B_3$, the EL element $E_{2G,3}$, the anode line $A_{2G}$, and the EL element $E_{2G,2}$ to the scanning switch $\mathbf{15}_2$; . . . ; and the route from the scanning switch $\mathbf{15}_n$ through the cathode line $B_n$, the EL element $E_{2G,n}$, the anode line $A_{2G}$, and the EL element $E_{2G,2}$ to the scanning switch $\mathbf{15}_2$, in addition to the route from the variable current source $\mathbf{17}_{2G}$ through the drive switch $\mathbf{16}_{2G}$, the anode line $A_{2G}$, and the EL element $E_{2G,2}$ to the scanning switch $\mathbf{15}_2$. Thereafter, during the scanning period of $B_2$, the steady light-emitting state is sustained by a drive current flowing in via the route from the variable current source $\mathbf{17}_{2G}$through the drive switch $\mathbf{16}_{2G}$, the anode line $A_{2G}$, and the EL element $E_{2G,2}$ to the scanning switch $\mathbf{15}_2$.

Moreover, at the moment the scanning switches and the drive switches are switched over, the voltage across the EL element $E_{2B,2}$ starts becoming approximately $Vcc+V_B$ (precisely speaking, equal to $(n-1)\cdot(Vcc+V_B)/n$). Therefore, charge currents drive the EL element $E_{2B,2}$ into the steady light-emitting state instantly by flowing therein from a plurality of routes such as the route from the scanning switch $\mathbf{15}_1$ through the cathode line $B_1$, the EL element $E_{2B,1}$, the anode line $A_{2B}$, and the EL element $E_{2B,2}$ to the scanning switch $\mathbf{15}_2$; the route from the scanning switch $\mathbf{15}_3$ through the cathode line $B_3$, the EL element $E_{2B,3}$, the anode line $A_{2B}$, and the EL element $E_{2B,2}$ to the scanning switch $\mathbf{15}_2$; . . . ; and the route from the scanning switch $\mathbf{15}_n$ through the cathode line $B_n$, the EL element $E_{2B,n}$, the anode line $A_{2B}$, and the EL element $E_{2B,2}$ to the scanning switch $\mathbf{15}_2$, in addition to the route from the variable current source $\mathbf{17}_{2B}$ through the drive switch $\mathbf{16}_{2B}$, the anode line $A_{2B}$, and the EL element $E_{2B,2}$ to the scanning switch $\mathbf{15}_2$. Thereafter, during the scanning period of $B_2$, the steady light-emitting state is sustained by a drive current flowing in via the route from the variable current source $\mathbf{17}_{2B}$ through the drive switch $\mathbf{16}_{2B}$, the anode line $A_{2B}$, and the EL element $E_{2B,2}$ to the scanning switch $\mathbf{15}_2$.

Each of the light-emitting EL elements $E_{2R,2}$, $E_{2G,2}$, $E_{2B,2}$ reaches the light emission regulating voltage $Ve_R$, $Ve_G$, $Ve_B$ substantially at the same time the scan is changed over to come into the steady light-emitting state. Consequently, the pixel made up of the EL elements $E_{2R,2}$, $E_{2G,2}$, $E_{2B,2}$ is to display the desired color without a difference in color.

Figure 14A:
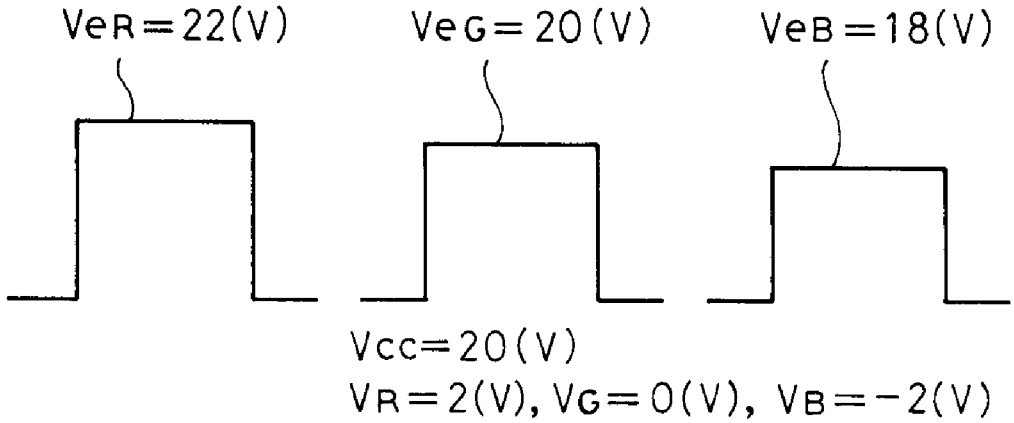
FIG. 14 shows variations in voltage across an EL element due to hue control.
Figure 14B:
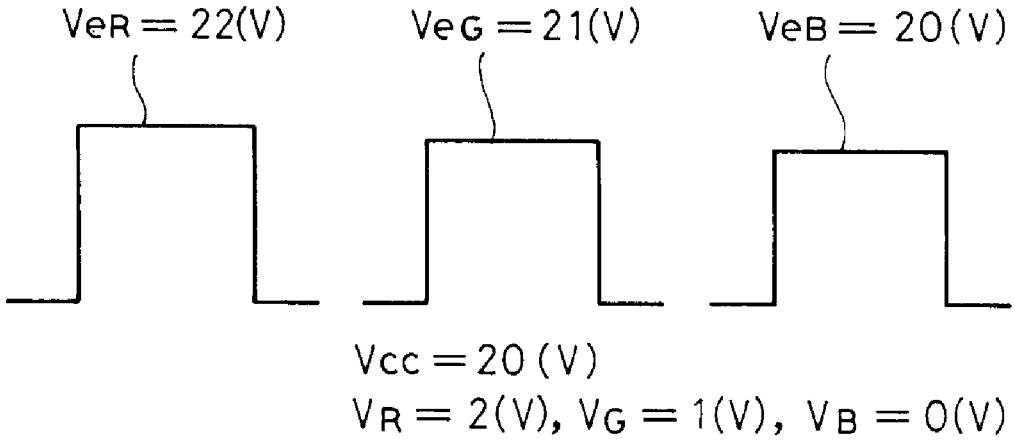

FIG. 14A shows a rectangular change in voltage across each of the EL elements for emitting light of three primary colors when a reverse bias potential Vcc=20 (V), and offset voltages $V_R$=2 (V), $V_G$=0 (V), $V_B$=−2 (V) are set. In this case, the voltage of each of the EL elements is the current voltage across each of the EL elements at the time of light emission, namely, $Ve_R$=22 (V), $Ve_G$=20 (V), and $Ve_B$=18 (V). Suppose that the user operates the data input portion 19 to increase the luminosity of green by +1 and the luminosity of blue by +2, respectively, under the state of emitting light as such. This operation will cause the offset voltage $V_R$=2 (V) to remain as it is, but the offset voltages to change into $V_G$=1 (V) and $V_B$=0 (V). Accordingly, a change in voltage across each of the EL elements of the three colors occurs as shown in FIG. 14B at the time of light emission. Thus, since the reverse bias potential Vcc is fixed to 20 (V), the voltage across each of the EL elements becomes $Ve_R$=22 (V), $Ve_G$=21 (V), and $Ve_B$=20 (V) at the time of light emission.

Figure 15:
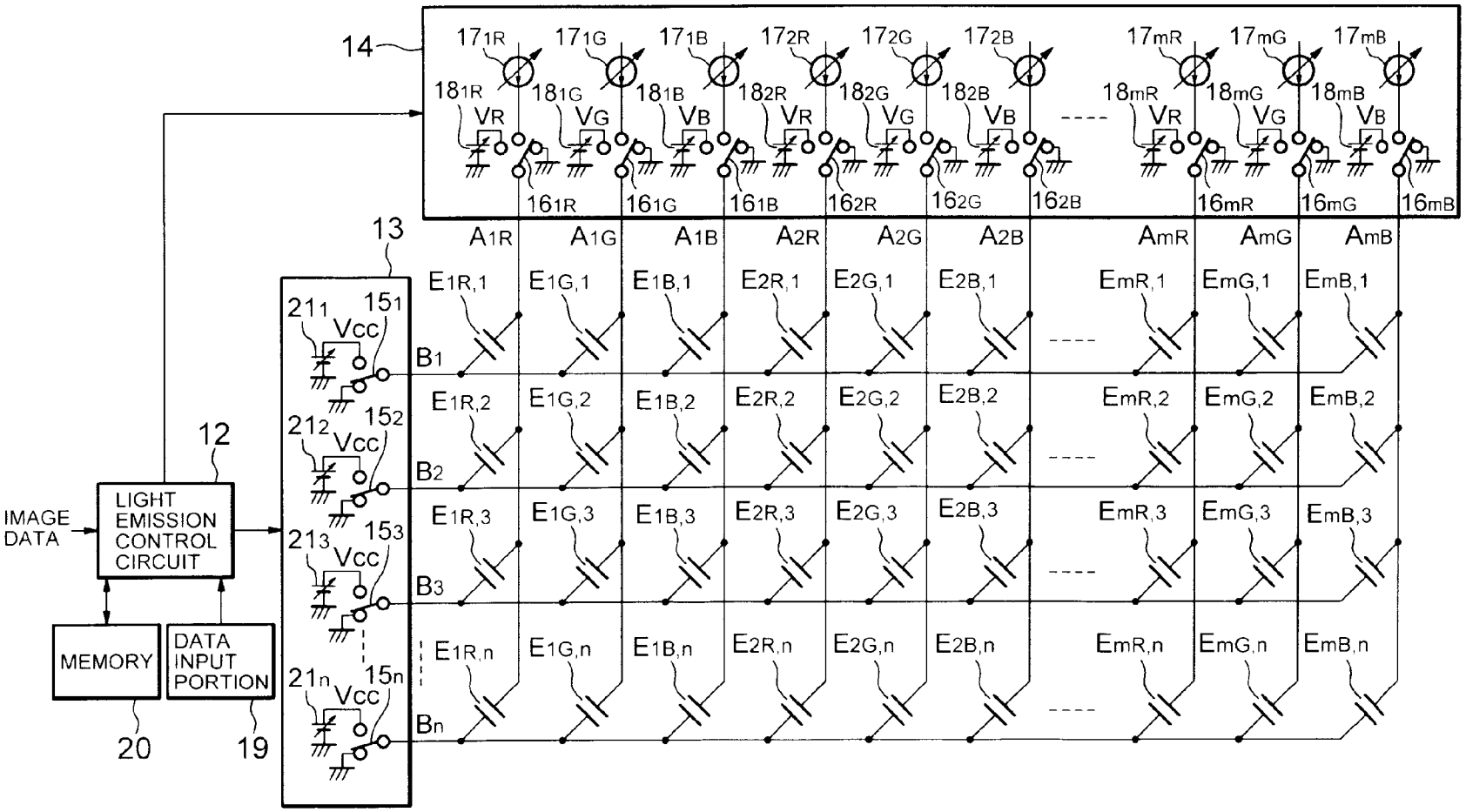
FIG. 15 is a block diagram showing part of another display device to which the present invention is applied.

FIG. 15 is a partial view showing another embodiment of a display device of the present invention. This display device comprises the capacitive light-emitting display panel 11, the light emission control circuit 12, the cathode line scanning circuit 13, and the anode line drive circuit 14. Though not shown in FIG. 15, the data input portion 19 and the memory 20 are connected to the light emission control circuit 12 as shown in FIG. 7. The cathode line scanning circuit 13 has the scanning switches $\mathbf{15}_1, \ldots, \mathbf{15}_n$ as well as variable voltage sources $\mathbf{21}_1, \ldots, \mathbf{21}_n$. The variable voltage sources $\mathbf{21}_1, \ldots, \mathbf{21}_n$ generate voltages to obtain the aforementioned reverse bias potential Vcc and the level of the voltage Vcc thereof is controlled by the light emission control circuit 12. The positive terminals of the variable voltage sources $\mathbf{21}_1, \ldots, \mathbf{21}_n$ are connected to one side of the stationary contacts of the scanning switches $\mathbf{15}_1, \ldots, \mathbf{15}_n$, while the negative terminals are connected to the ground. Other configuration is the same as those shown in FIGS. 7 and 8.

Figure 9:
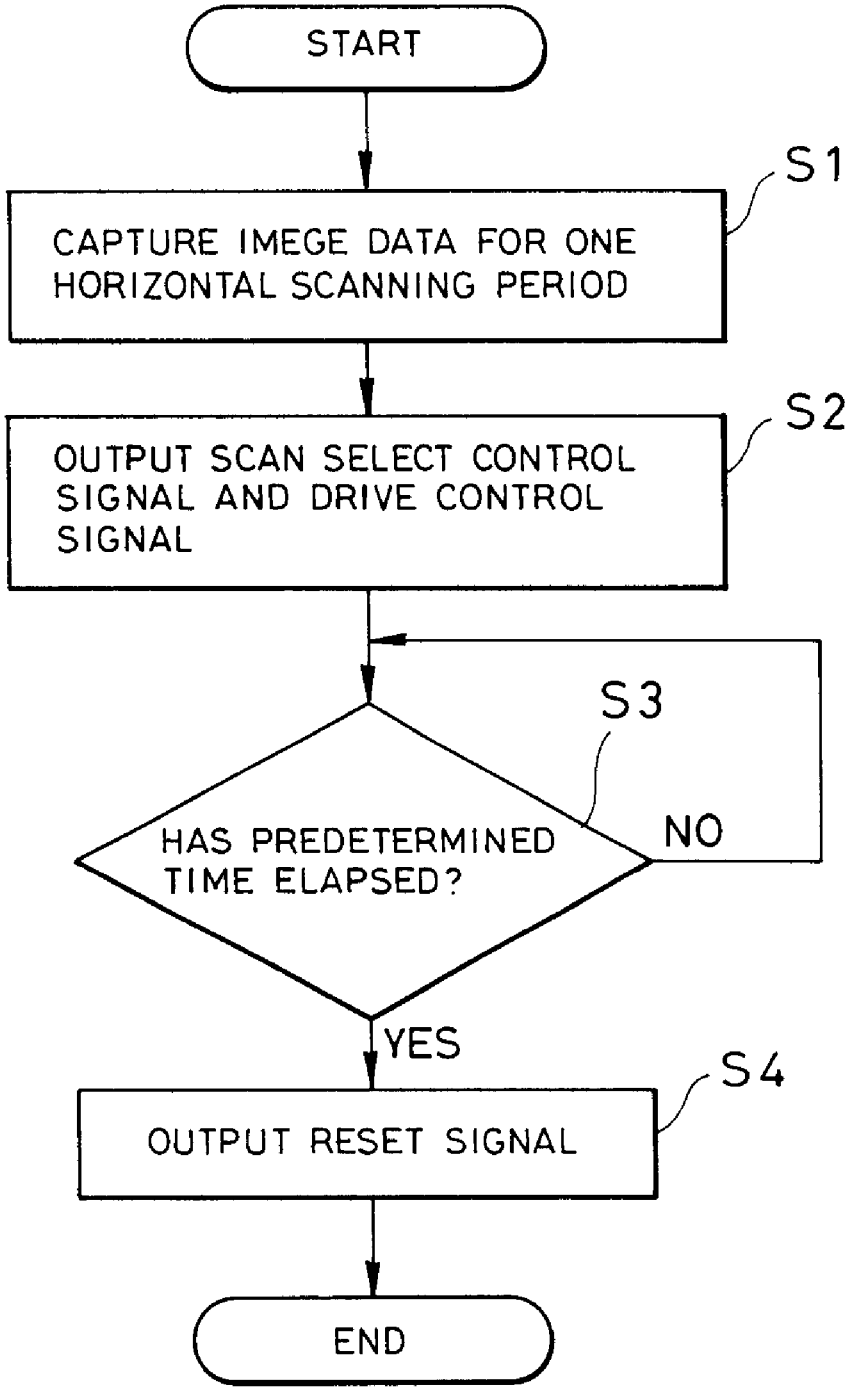
FIG. 9 is a flow diagram showing a light emission control routine.

The light emission control operation of the light-emitting display panel 11 by means of the light emission control circuit 12 shown in FIG. 15 is the same as that shown in the flow diagram of FIG. 9.

Figure 1:
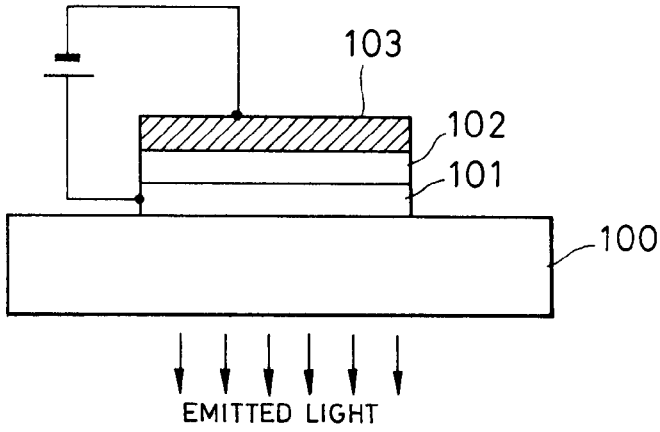
FIG. 1 is a cross-sectional view showing an organic electroluminescence element.
Figure 2:
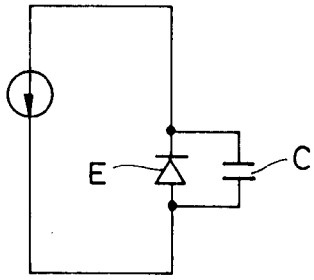
FIG. 2 is a view showing an equivalent circuit of an organic electroluminescence element.
Figure 16:
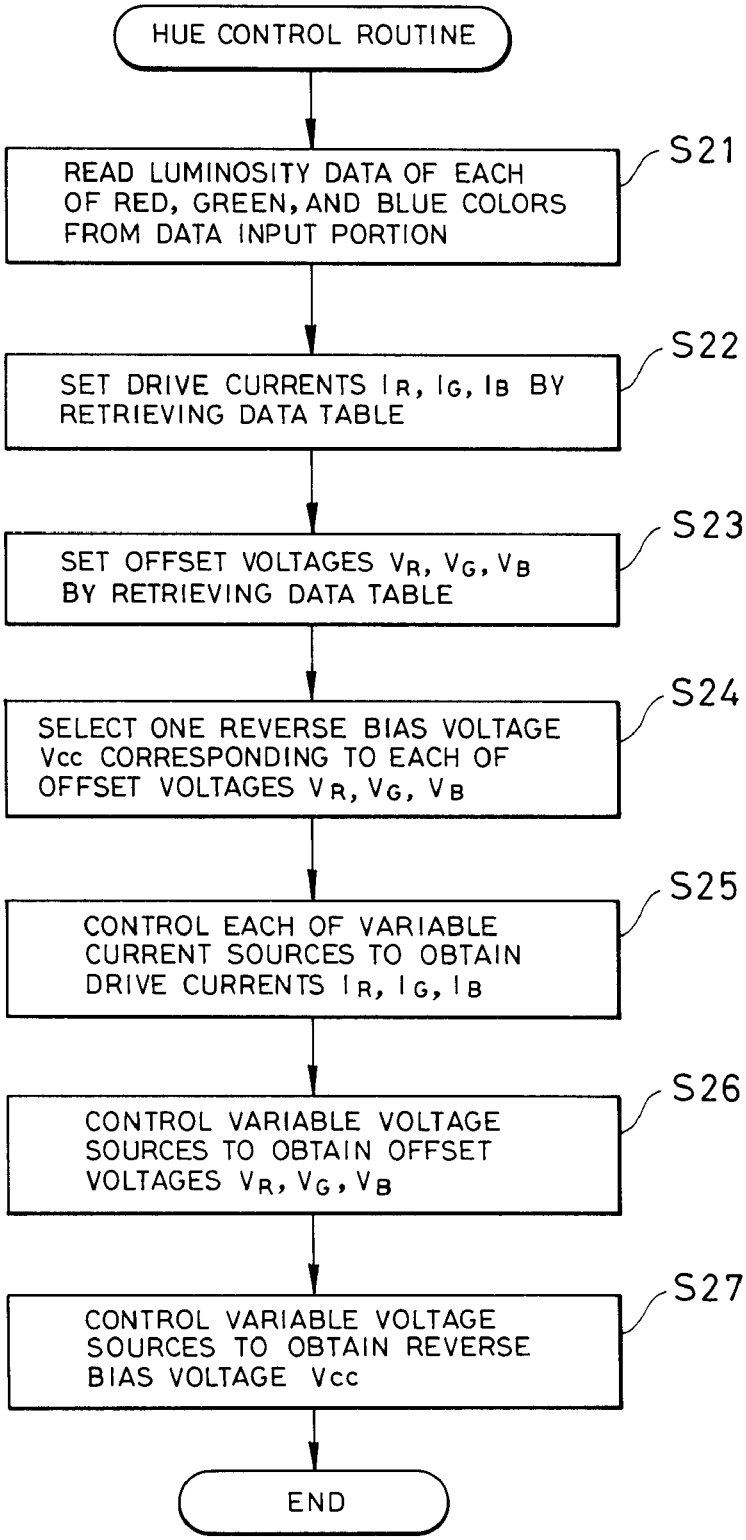
FIG. 16 is a flow diagram showing a hue control routine.

When the user actuates the data input portion 19, the light emission control circuit 12 carries out the hue control routine in accordance with the luminosity data of each of the red, green, and blue colors at that time. In this hue control routine, as shown in FIG. 16, the luminosity data of each of the red, green, and blue colors, which are outputted from the data input portion 19, is read (step S21). Then, the drive currents $I_R$, $I_G$, $I_B$, corresponding to each of the red, green, and blue colors, are set by retrieving the data table (step S22). Moreover, the offset voltages $V_R$, $V_G$, $V_B$ are set by means of retrieving the data table (step S23). Since the data tables of the drive currents $I_R$, $I_G$, $I_B$ and the offset voltages $V_R$, $V_G$, $V_B$, corresponding to the luminosity data of each of the red, green, and blue colors, are formed in the memory 20, these data tables are used to set the drive currents $I_R$, $I_G$, $I_B$ and the offset voltages $V_R$, $V_G$, $V_B$. The characteristics of voltage V—Current I—luminosity L of the EL elements shown in FIG. 2 are slightly different from each other in the EL elements for emitting red, green, and blue light. Accordingly, as shown in FIG. 17, in the data tables to be used in steps S22 and S23, drive current data Ir0–Ir31, Ig0–Ig31, Ib0–Ib31 and offset voltage data Vr0–Vr31, Vg0–Vg31, Vb0–Vb31 are determined, which correspond to the luminosity data (luminosity of 32 levels of halftone) of each of the red, green, and blue colors.

The light emission control circuit 12 selects only one common reverse bias voltage Vcc corresponding to each of the offset voltages $V_R$, $V_G$, $V_B$, which have been set (step S24). The light emission control circuit 12 controls the variable current sources $\mathbf{17}_{1R}, \mathbf{17}_{1G}, \mathbf{17}_{1B}, \ldots, \mathbf{17}_{mR}, \mathbf{17}_{mG}, \mathbf{17}_{mB}$ so as to obtain the drive currents $I_R$, $I_G$, $I_B$, which have been set (step S25). In addition, the light emission control circuit 12 controls the output voltages of the variable voltage sources $\mathbf{18}_{1R}, \mathbf{18}_{1G}, \mathbf{18}_{1B}, \ldots, \mathbf{18}_{mR}, \mathbf{18}_{mG}, \mathbf{18}_{mB}$ so that the output voltages become the offset voltages $V_R$, $V_G$, $V_B$, which have been set (step S26). Moreover, the light emission control circuit 12 controls the output voltages of the variable voltage sources $\mathbf{21}_1, \ldots, \mathbf{21}_n$ so that the output voltages become the reverse bias voltage Vcc that has been set (step S27).

The offset voltage $V_R$ has a value of $V_R=Ve_R-Vcc$; the offset voltage $V_G$ has a value of $V_G=Ve_G-Vcc$; and the offset voltage $V_B$ has a value of $V_B=Ve_B-Vcc$. Accordingly, letting the current value of the reverse bias voltage Vcc equal to V1, the reverse bias voltage Vcc is changed to V2 to change the offset voltages $V_R$, $V_G$, $V_B$ to within the allowable range of voltages from $V_{LL}$ to $V_{HL}$ with the voltages $Ve_R$, $Ve_G$, $Ve_B$ being sustained. For example, where V1=20 (V) and it is set by retrieving the table data in step S23 such that voltage $V_R$=5 (V), $V_G$=1 (V), and $V_B$=0 (V), the offset voltage $V_R$ exceeds the aforementioned allowable range of voltage from $V_{LL}$ to $V_{HL}$, which is, −5 (V) to +3 (V). The offset voltage $V_R$=5 (V) is decreased by 2 (V) to fall within the allowable range of −5 (V) to +3 (V). Thus, it is set such that $V_R$=5 (V)−2 (V)=3 (V), $V_G$=1 (V)−2 (V)=−1 (V), and $V_B$=0 (V)−2 (V)=−2 (V). In addition, the reverse bias voltage Vcc is set to V2=20 (V)+2 (V)=22 (V) so that it is sustained that voltages $Ve_R$=25 (V), $Ve_G$=21 (V), and $Ve_B$=20 (V).

Each of the offset voltages $V_R$, $V_G$, $V_B$ and the reverse bias voltage Vcc can be set in steps S23 and S24 as follows. If the allowable range of offset voltage from $V_{LL}$ to $V_{HL}$ is from −5 (V) to +3 (V), the center voltage thereof is $(V_L+V_{HL})/2=1$ (V). The average voltage of the offset voltages $V_R$, $V_G$, $V_B$ is made equal to the center voltage. That is, the offset voltages $V_R$, $V_G$, $V_B$ are set to satisfy that $(V_R+V_G+V_B)/3=-1$ (V). In step S23, it has been set such that $V_R$=5 (V), $V_G$=1 (V), $V_B$=0 (V), the current average voltage of the offset voltages $V_R$, $V_G$, $V_B$ is equal to $(V_R+V_G+V_B)/3=2$ (V). Therefore, in order to make the average voltage equal to −1 (V), the light emission control circuit 12 decreases the offset voltages $V_R$, $V_G$, $V_B$ by 3 (V) to be set such that $V_R$=5 (V)−3 (V)=2 (V), $V_G$=1 (V) 3 (V)=−2 (V), and $V_B$=0 (V)−3 (V)=−3 (V). On the other hand, in step S24, the light emission control circuit 12 can set the reverse bias voltage Vcc such that V2=20 (V)+3 (V)=23 (V).

In the hue control routine of FIG. 16, the drive currents $I_R$, $I_G$, $I_B$ and the offset voltages $V_R$, $V_G$, $V_B$ are set by means of retrieving the data tables in steps S22 and S23. However, the reverse bias voltage Vcc may also be set by means of retrieving the data tables in step S24. In this case, the voltages $Ve_R$, $Ve_G$, $Ve_B$ are determined in accordance with the drive currents $I_R$, $I_G$, $I_B$, and the total voltage of the offset voltages $V_R$, $V_G$, $V_B$ and the reverse bias voltage Vcc are made equal to the voltages $Ve_R$, $Ve_G$, $Ve_B$. In the case where $Ve_R$=25 (V), $Ve_G$=21 (V), and $Ve_B$=20 (V), the relationship between the offset voltages $V_R$, $V_G$, $V_B$ and the reverse bias voltage Vcc is as shown in FIGS. 18A to 18C for each of the red, green, and blue colors. The voltage that each of the offset voltages $V_R$, $V_G$, $V_B$ can provide is to lie within the range of −5 (V) to +3 (V). Within this allowable range of the offset voltages, the bias voltage Vcc becomes a common voltage to the red, green, and blue colors, so that the bias voltage may take any value within the range of 25 (V) to 22 (V) in each of the red, green, and blue colors. Therefore, setting the common reverse bias voltage Vcc to a voltage within the range of 25 (V) to 22 (V) allows each of the offset voltages $V_R$, $V_G$, $V_B$ to be set.

For example, in the case where the user operates the data input portion 19 to result in luminosity data for extremely decreasing the luminosity of the red color in step S21, suppose that the relationship between the offset voltage $V_R$ and the reverse bias voltage Vcc is shown in FIG. 18A to FIG. 19 in accordance with the luminosity data. If the relationship between the offset voltages $V_G$, $V_B$ of the green and blue colors and the reverse bias voltage Vcc remains as shown in FIGS. 18B and 18C, the reverse bias voltage Vcc common to the red, green, and blue colors cannot be obtained. In this case, priority is placed on the green color with high luminosity to allow the reverse bias voltage Vcc to be set using the relationship of FIG. 18B. The reverse bias voltage Vcc=18 (V), which is the lowest in the relationship of FIG. 18B, is selected, and the offset voltages are set such that $V_R$=5 (V), $V_G$=3 (V), and $V_B$=2 (V).

In the aforementioned embodiment, the data tables are used to retrieve and set the drive currents $I_R$, $I_G$, $I_B$ and the offset voltages $V_R$, $V_G$, $V_B$, however, the offset voltages $V_R$, $V_G$, $V_B$ may be calculated. Next, the operation is explained in which the offset voltages $V_R$, $V_G$, $V_B$ are determined by calculation.

Figure 20:
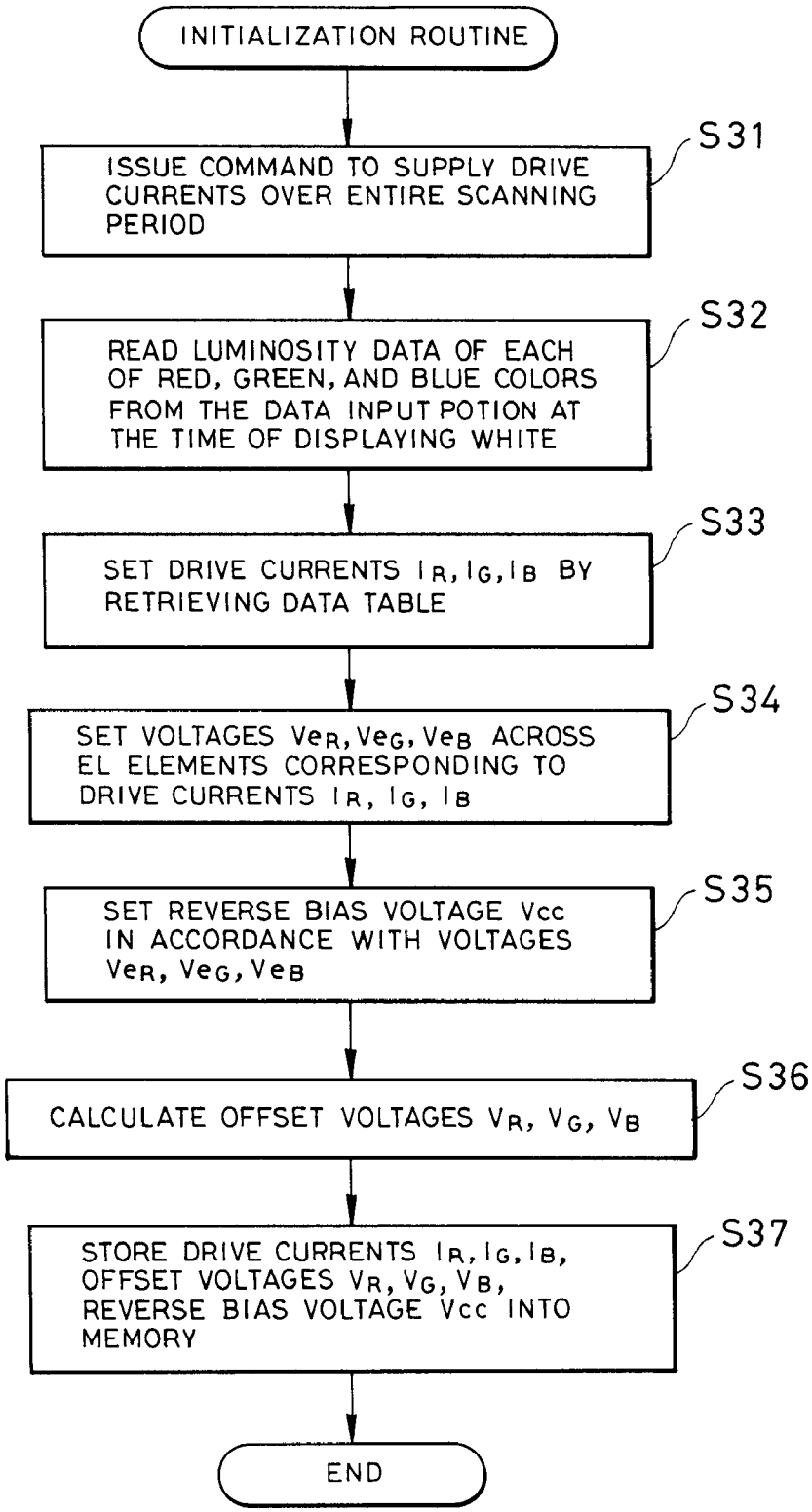
FIG. 20 is a flow diagram showing an initialization routine.

The light emission control circuit 12 carries out the initialization routine for initialization. In the initialization routine, as shown in FIG. 20, a command is generated for supplying drive currents over an entire scanning period (step S31). The user is required to control the data input portion 19 in accordance with the command so that the light-emitting display panel 11 displays white color and the luminosity data of each of the red, green, and blue colors at that time is read from the data input portion 19 (step S32). Then, the drive currents $I_R$, $I_G$, $I_B$ are determined in accordance with the read luminosity data (step S33). Then, the voltages $Ve_R$, $Ve_G$, $Ve_B$ across the EL elements for emitting red, green, and blue light, corresponding to the drive currents $I_R$, $I_G$, $I_B$, are set (step S34). Since the data tables of the drive currents $I_R$, $I_G$, $I_B$ and the voltages $Ve_R$, $Ve_G$, $Ve_B$, corresponding to the luminosity data, are formed in the memory 20 for each of the red, green, and blue colors, the drive currents $I_R$, $I_G$, $I_B$ and the voltages $Ve_R$, $Ve_G$, $Ve_B$ are set using the data tables.

The light emission control circuit 12 sets the reverse bias voltage Vcc in accordance with the voltages $Ve_R$, $Ve_G$, $Ve_B$, which have been set in step S34 (step S35). In step S35, the voltage levels of the voltages $Ve_R$, $Ve_G$, $Ve_B$ are compared with each other, and the second highest voltage is set as the reverse bias voltage Vcc. If the voltages $Ve_R$, $Ve_G$, $Ve_B$ have a high and low relationship such that $Ve_R>Ve_G>Ve_B$, the voltage level of $Ve_G$ is set as the reverse bias voltage Vcc. In addition, in step S35, the levels of the voltages $Ve_R$, $Ve_G$, $Ve_B$ may be compared with each other and an intermediate voltage between the highest and lowest voltages may be set to the reverse bias voltage Vcc. If the voltages $Ve_R$, $Ve_G$, $Ve_B$ have a high and low relationship such that $Ve_R>Ve_G>Ve_B$, the voltage level of $(Ve_R+Ve_B)/2$ is set to the reverse bias voltage Vcc.

After having carried out step S35, the light emission control circuit 12 calculates the offset voltages $V_R$, $V_G$, $V_B$. The offset voltages $V_R$, $V_G$, $V_B$ are calculated such that $V_R=Ve_R$ Vcc, $V_G=Ve_G-Vcc$, and $V_B=Ve_G-Vcc$. In the case where the former method for setting the reverse bias voltage Vcc in step S35 is used, the offset voltage corresponding to the highest voltage of the voltages $Ve_R$, $Ve_G$, $Ve_B$ is positive. The second offset voltage corresponding to the highest voltage is 0 (V), while the offset voltage corresponding to the lowest voltage is negative.

After having carried out step S36, the light emission control circuit 12 writes the drive currents $I_R$, $I_G$, $I_B$, the reverse bias voltage Vcc, and the offset voltages $V_R$, $V_G$, $V_B$ into the memory 20 and allows the same to be stored therein (step S37).

In such an initialization operation, if the voltages $Ve_R$, $Ve_G$, $Ve_B$ are set, for example, such that $Ve_R$=22 (V), $Ve_G$=20 (V), and $Ve_B$=18 (V), the voltage levels of the voltages $Ve_R$, $Ve_G$, $Ve_B$ are compared with each other in step S35 to set the second highest voltage, $Ve_G$=20 (V), is set to the reverse bias voltage Vcc. Therefore, in step S36, the offset voltages $V_R$, $V_G$, $V_B$ are set such that $V_R$=2 (V), $V_G$=0 (V), and $V_B$=2 (V).

The allowable range of the offset voltages is set for each of the red, green, and blue colors. For example, the allowable range of red color $V_{LLR}$ to $V_{HLR}$ lies within the range of −5 (V) to 3 (V), the allowable range of green color $V_{LLG}$ to $V_{HLG}$ lies within the range of −5 (V) to 2 (V), and the allowable range of red color $V_{LLB}$ to $V_{HLB}$ lies within the range of −5 (V) to 1 (V).

After having completed the initialization operation, the light emission control circuit 12 allows the user to operate the data input portion 19 to carry out either the brightness control routine or the hue control routine.

When the user actuates the brightness control lever (not shown) of the data input portion 19, the light emission control circuit 12 carries out the brightness control routine in accordance with the luminosity data at that time. The brightness control lever of the data input portion 19 is an actuator for controlling the overall luminosity of the display screen. The user's actuation of the lever causes the luminosity data of each of the red, green, and blue colors, which are outputted from the data input portion 19, to vary by the same luminosity.

Figure 21:
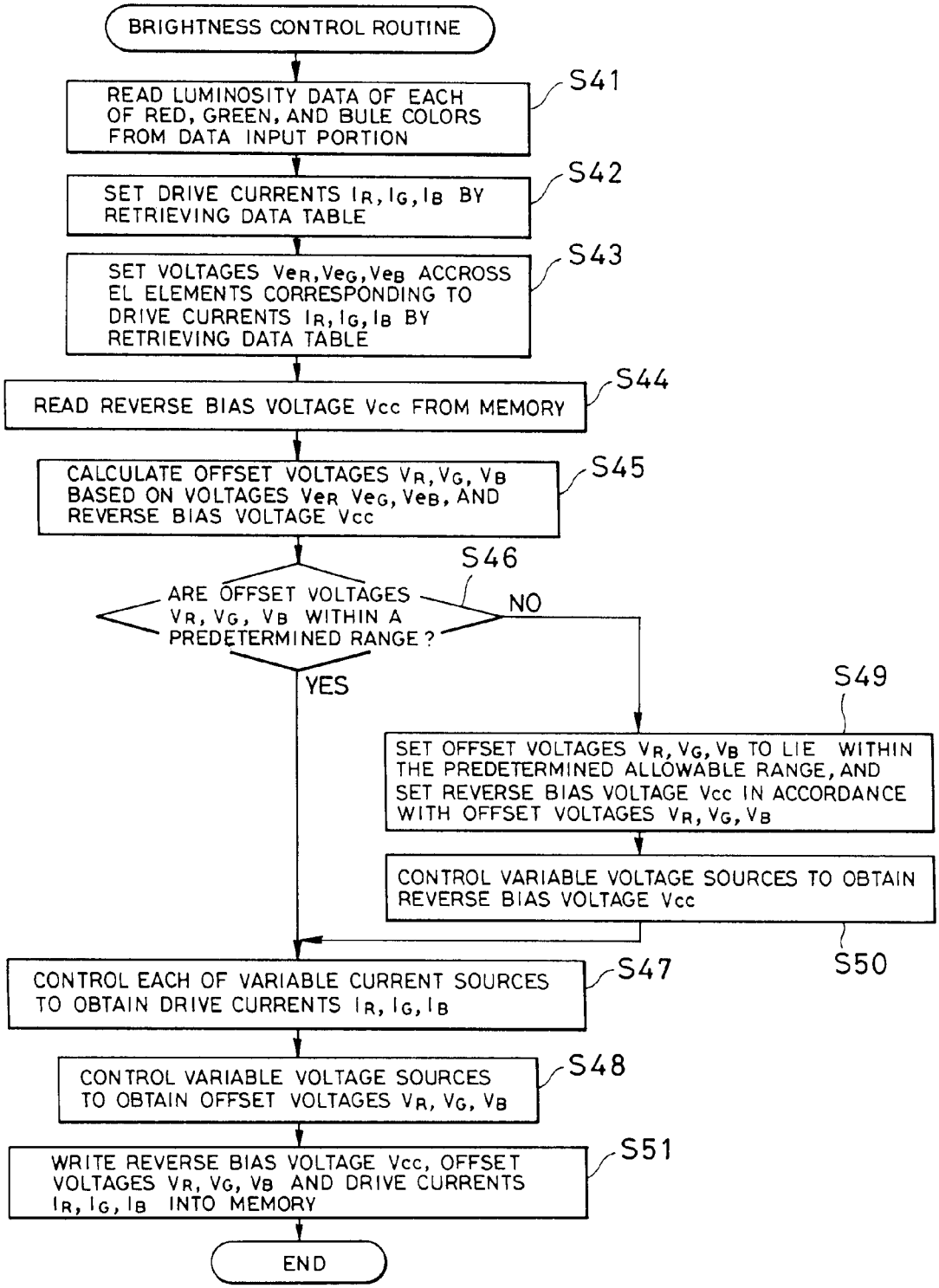
FIG. 21 is a flow diagram showing a brightness control routine.

In the brightness control routine, as shown in FIG. 21, the light emission control circuit 12 first reads the luminosity data of each of the red, green, and blue colors, which are outputted from the data input portion 19 (step S41). Then, the drive currents $I_R$, $I_G$, $I_B$, corresponding to the luminosity data of each of the red, green, and blue colors, are set by retrieving the data tables (step S42). Moreover, the voltages $Ve_R$, $Ve_G$, $Ve_B$ across EL elements for emitting red, green, and blue light, corresponding to the drive currents $I_R$, $I_G$, $I_B$, are set by retrieving the data tables (step S43). The operations of steps S42 and S43 are the same as those of steps S33 and S34.

The light emission control circuit 12 reads the reverse bias voltage Vcc that is stored in the memory 20 (step S44). Then, the light emission control circuit 12 calculates the offset voltages $V_R$, $V_G$, $V_B$, using the voltages $Ve_R$, $Ve_G$, $Ve_B$ of step S43 and the reverse bias voltage Vcc that has been read (step S45). That is, the offset voltages are calculated such that $V_R=Ve_R-Vcc$, $V_G=Ve_G-Vcc$, and $V_B=Ve_B-Vcc$.

The light emission control circuit 12 determines whether each of the calculated offset voltages $V_R$, $V_G$, $V_B$ lies within a predetermined allowable range (step S46). Since the offset voltages need to be set so as to avoid cross-talk light emission, each of the offset voltages is limited to the red allowable range of $V_{LLR}$ to $V_{HLR}$, the allowable range of $V_{LLG}$ to $V_{HLG}$, and the allowable range of $V_{LLB}$ to $V_{HLB}$. If each of the offset voltages $V_R$, $V_G$, $V_B$ lies within the corresponding predetermined allowable ranges of $V_{LLR}$ to $V_{HLR}$, $V_{LLG}$ to $V_{HLG}$, and $V_{LLB}$ to $V_{HLB}$, the variable current sources 17$_{1R}$, 17$_{1G}$, 17$_{1B}$, . . . , 17$_{mR}$, 17$_{mG}$, 17$_{mB}$ are controlled so as to obtain the drive currents $I_R$, $I_G$, $I_B$, which have been set (step S47). In addition, the output voltages of the variable voltage sources 18$_{1R}$, 18$_{1G}$, 18$_{1B}$, . . . , 18$_{mR}$, 18$_{mG}$, 18$_{mB}$ are controlled so as to be the offset voltages $V_R$, $V_G$, $V_B$, which have been set (step S48).

In step S46, if any one of the offset voltages $V_R$, $V_G$, $V_B$ does not lie within the corresponding predetermined allowable ranges of $V_{LLR}$ to $V_{HLR}$, $V_{LLG}$ to $V_{HLG}$, and $V_{LLB}$ to $V_{HLB}$, the reverse bias voltage Vcc and each of the offset voltages $V_R$, $V_G$, $V_B$ are reset so that each of the offset voltages $V_R$, $V_G$, $V_B$ lies within the corresponding predetermined allowable ranges of $V_{LLR}$ to $V_{HLR}$, $V_{LLG}$ to $V_{HLG}$, and $V_{LLB}$ to $V_{HLB}$ (step S49). The reverse bias voltage Vcc in step S49 is reset in the same manner as in the aforementioned step S35, while each of the offset voltages $V_R$, $V_G$, $V_B$ is reset in the same manner as in step S36.

After having carried out step S49, the light emission control circuit 12 controls the output voltages of the variable voltage sources 21$_1$, . . . , 21$_n$ so as to be the reverse bias voltage Vcc which has been set (step S50). The process proceeds to step S47 to allow the variable current sources 17$_{1R}$, 17$_{1G}$, 17$_{1B}$, . . . , 17$_{mR}$, 17$_{mG}$, 17$_{mB}$ to be controlled so as to obtain the drive currents $I_R$, $I_G$, $I_B$, which have been set. Thereafter, in step S48, the output voltages of the variable voltage sources 18$_{1R}$, 18$_{1G}$, 18$_{1B}$, . . . , 18$_{mR}$, 18$_{mG}$, 18$_{mB}$ are controlled so as to become the offset voltages $V_R$, $V_G$, $V_B$, which have been set.

After having carried out step S48, the light emission control circuit 12 allows the reverse bias voltage Vcc, the offset voltages $V_R$, $V_G$, $V_B$ and the drive currents $I_R$, $I_G$, $I_B$, which have been set, to be stored in the memory 20 (step S51).

If the voltages $Ve_R$, $Ve_G$, $Ve_B$ across the EL elements for emitting red, green, and blue light are set, for example, such that $Ve_R$=30 (V), $Ve_G$=29 (V), and $Ve_B$=26 (V) by actuating the brightness control lever of the data input portion 19 in step S43, and differences between each of the voltages $Ve_R$, $Ve_G$, $Ve_B$ and the reverse bias voltage Vcc=20 (V) are calculated as the offset voltages $V_R$, $V_G$, $V_B$, then $V_R$=10 (V), $V_G$=9 (V), and $V_B$=6 (V). If the allowable range of red color $V_{LLR}$ to $V_{HLR}$ lies within the range of −5 (V) to 3 (V), the allowable range of green color $V_{LLG}$ to $V_{HLG}$ lies within the range of −5 (V) to 2 (V), and the allowable range of red color $V_{LLB}$ to $V_{HLB}$ lies within the range of −5 (V) to 1 (V) as described above, then all the offset voltages calculated in step S45 lie outside the allowable ranges. Thus, each of the offset voltages $V_R$, $V_G$, $V_B$ and the reverse bias voltage Vcc are reset in step S49, and the voltage levels of the voltages $Ve_R$, $Ve_G$, $Ve_B$ are compared with each other, so that the second highest voltage $Ve_G$=29 (V) is reset to the reverse bias voltage Vcc. Each of the offset voltages $V_R$, $V_G$, $V_B$ is reset such that $V_R$=1 (V), $V_G$=0 (V), and $V_B$=−3 (V).

Figure 22:
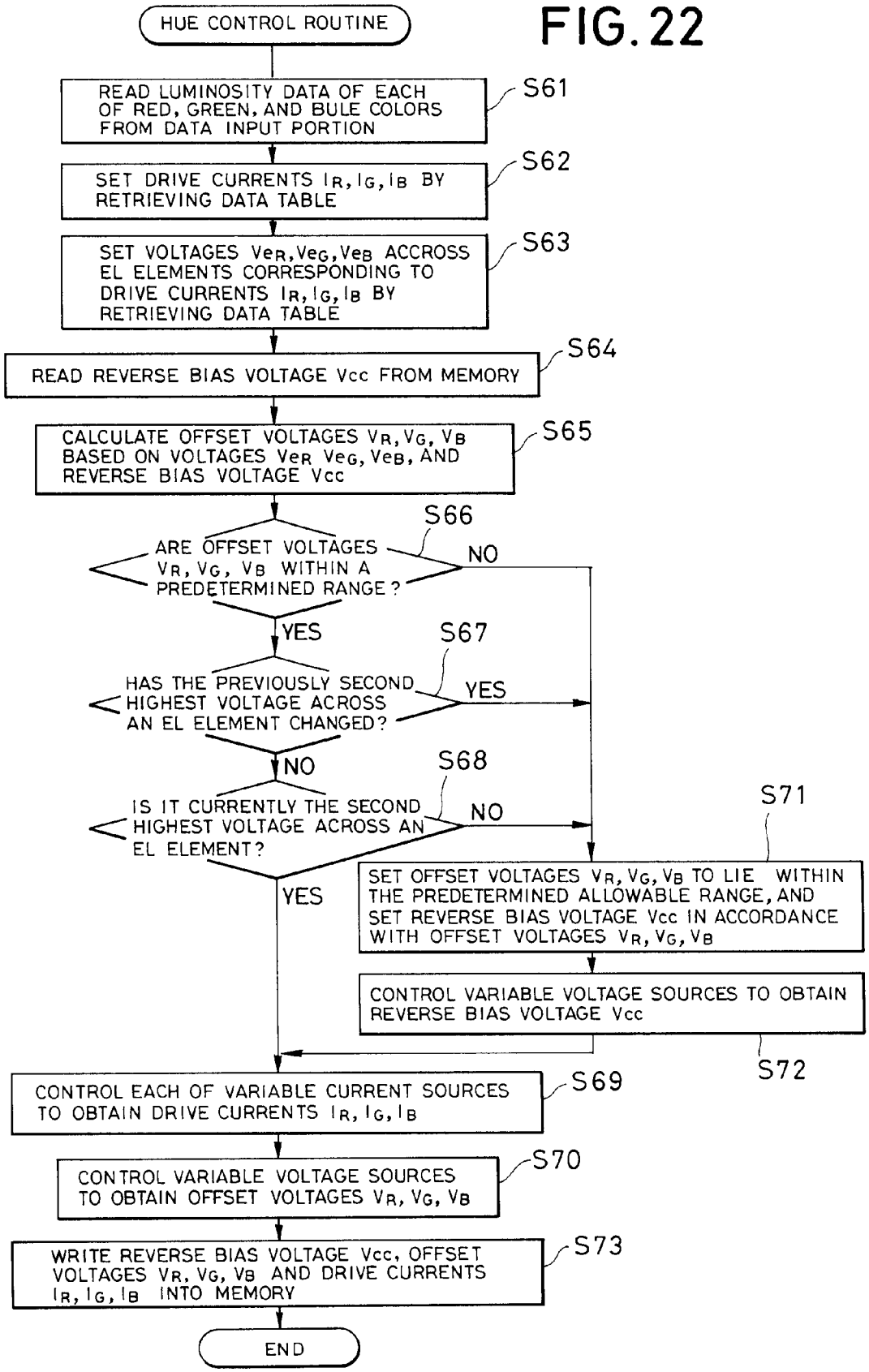
FIG. 22 is a flow diagram showing a hue control routine.

When the user actuates the brightness control lever of the data input portion 19, the light emission control circuit 12 carries out the hue control routine in accordance with the luminosity data at that time. In the hue control routine, as shown in FIG. 22, the light emission control circuit 12 first reads the luminosity data of each of the red, green, and blue colors,which are outputted from the data input portion 19 (step S61). Then, the drive currents $I_R$, $I_G$, $I_B$ corresponding to the luminosity data of each of the red, green, and blue colors, are set by retrieving the data tables (step S62). Moreover, the voltages $Ve_R$, $Ve_G$, $Ve_B$ across EL elements for emitting red, green, and blue light, corresponding to the drive currents $I_R$, $I_G$, $I_B$, are set by retrieving the data tables (step S63). The operations of steps S62 and S63 are the same as those of steps S33 and S34.

The light emission control circuit 12 reads the reverse bias voltage Vcc that is stored in the memory 20 (step S64). Then, the light emission control circuit 12 calculates the offset voltages $V_R$, $V_G$, $V_B$, using the voltages $Ve_R$, $Ve_G$, $Ve_B$ of step S63 and the reverse bias voltage Vcc that has been read (step S65). That is, the offset voltages are calculated such that $V_R$=$Ve_R$−Vcc, $V_G$=$Ve_G$−Vcc, and $V_B$=$Ve_B$−Vcc.

The light emission control circuit 12 determines whether each of the calculated offset voltages $V_R$, $V_G$, $V_B$ lies within a predetermined allowable range (step S66). Since the offset voltages need to be set so as to avoid cross-talk light emission, each of the offset voltages is limited to the red allowable range of $V_{LLR}$ to $V_{HLR}$, the allowable range of $V_{LLG}$ to $V_{HLG}$, and the allowable range of $V_{LLB}$ to $V_{HLB}$. If each of the offset voltages $V_R$, $V_G$, $V_B$ lies within the corresponding predetermined allowable ranges of $V_{LLR}$ to $V_{HLR}$, $V_{LLG}$ to $V_{HLG}$, and $V_{LLB}$ to $V_{HLB}$, it is determined whether the second highest voltage of the voltages $Ve_R$, $Ve_G$, $Ve_B$, which are stored in the memory 20, has changed (step S67). That is, it is determined whether the voltage across an EL element for a color with the second highest voltage of the previous voltages $Ve_R$, $Ve_G$, $Ve_B$, which are stored in the memory 20, has changed into a different voltage due to the current setting of the voltages $Ve_R$, $Ve_G$, $Ve_B$ in step S63. If the voltage across an EL element for a color with the second highest voltage of the previous voltages $Ve_R$, $Ve_G$, $Ve_B$ has not changed, it is determined whether the voltage across an EL element for the color is currently the second highest voltage (step S68). That is, it is determined whether the second highest voltage of the previous voltages $Ve_R$, $Ve_G$, $Ve_B$ and the second highest voltage of the current voltages $Ve_R$, $Ve_G$, $Ve_B$ are the voltage across an EL element of the same color.

If the result of the determination in step S68 shows that the voltage across an EL element of a color with the previous second highest voltage has the current second highest voltage, the variable current sources 17$_{1R}$, 17$_{1G}$, 17$_{1B}$, . . . , 17$_{mR}$, 17$_{mG}$, 17$_{mB}$ are controlled so as to achieve the drive currents $I_R$, $I_G$, $I_B$, which have been set (step S69). In addition, the output voltages of the variable voltage sources 18$_{1R}$, 18$_{1G}$, 18$_{1B}$, . . . , 18$_{mR}$, 18$_{mG}$, 18$_{mB}$ are controlled to achieve the offset voltages $V_R$, $V_G$, $V_B$, which have been set (step S70).

If the determination in step S66 shows that each of the offset voltages $V_R$, $V_G$, $V_B$ does not lie within the predetermined allowable range of voltage, if the determination in step S67 shows that the voltage across an EL element for a color with the second highest voltage of the previous voltages $Ve_R$, $Ve_G$, $Ve_B$ has changed, or if the determination in step S68 shows that the voltage across an EL element for a color with the second highest voltage of the previous voltages $Ve_R$, $Ve_G$, $Ve_B$ is not currently the second highest voltage, the reverse bias voltage Vcc and each of the offset voltages $V_R$, $V_G$, $V_B$ are reset so that each of the offset voltages $V_R$, $V_G$, $V_B$ becomes a voltage within the corresponding predetermined range of voltage $V_{LLR}$ to $V_{HLR}$, $V_{LLG}$ to $V_{HLG}$, and $V_{LLB}$ to $V_{HLB}$ (step S71). The reverse bias voltage Vcc is reset in step S71 in the same manner as in the aforementioned step S35, while each of the offset voltages $V_R$, $V_G$, $V_B$ is reset in the same manner as in step S36.

After having carried out step S71, the light emission control circuit 12 controls the output voltages of the variable voltage sources $21_1, \ldots, 21_n$ so as to achieve the reverse bias voltage Vcc which has been set (step S72). Then, in step S69, the light emission control circuit 12 controls the variable current sources $17_{1R}, 17_{1G}, 17_{1B}, \ldots, 17_{mR}, 17_{mG}, 17_{mB}$ so as to achieve the drive currents $I_R$, $I_G$, $I_B$, and thereafter, controls the output voltages of the variable voltage sources $18_{1R}, 18_{1G}, 18_{1B}, \ldots, 18_{mR}, 18_{mG}, 18_{mB}$ so as to achieve the offset voltages $V_R$, $V_G$, $V_B$ in step S70. After having carried out step S70, the light emission control circuit 12 allows the reverse bias voltage Vcc, the offset voltages $V_R$, $V_G$, $V_B$, and the drive currents $I_R$, $I_G$, $I_B$, which have been set, to be stored in the memory 20 (step S73).

If the voltages $Ve_R$, $Ve_G$, $Ve_B$ across the EL elements for emitting red, green, and blue light are set, for example, such that $Ve_R$=23 (V), $Ve_G$=20 (V), and $Ve_G$=21 (V) by actuating the brightness control lever of the data input portion 19 in step S63, and differences between each of the voltages $Ve_R$, $Ve_G$, $Ve_B$ and the reverse bias voltage Vcc=20 (V) are calculated as the offset voltages $V_R$, $V_G$, $V_B$, then $V_R$=3 (V), $V_G$=0 (V), and $V_B$=1 (V). If the allowable range of red color $V_{LLR}$ to $V_{HLR}$ lies within the range of −5 (V) to 3 (V), the allowable range of green color $V_{LLG}$ to $V_{HLG}$ lies within the range of −5 (V) to 2 (V), and the allowable range of red color $V_{LLB}$ to $V_{HLB}$ lies within the range of −5 (V) to 1 (V) as described above, then all the offset voltages calculated in step S65 lie within the allowable ranges. If the previous voltages $Ve_R$, $Ve_G$, $Ve_B$ are such that $Ve_R$=22 (V), $Ve_G$=20 (V), and $Ve_G$=18 (V), the previously second highest voltage is the $Ve_G$ or the voltage across an EL element for green color. However, the currently second highest voltage is the $Ve_B$ or the voltage across an EL element for blue color. Thus, each of the offset voltages $V_R$, $V_G$, $V_B$ and the reverse bias voltage Vcc are reset in step S61, and the voltage levels of the voltages $Ve_R$, $Ve_G$, $Ve_B$ are compared with each other, so that the second highest voltage $Ve_B$=21 (V) is reset to the reverse bias voltage Vcc. Each of the offset voltages $V_R$, $V_G$, $V_B$ is reset such that $V_R$=2 (V), $V_G$=−1 (V), and $V_B$=0 (V).

The predetermined allowable ranges $V_{LLR}$ to $V_{HLR}$, $V_{LLG}$ to $V_{HLG}$, and $V_{LLB}$ to $V_{HLB}$, of each of the aforementioned offset voltages $V_R$, $V_G$, $V_B$ are set as appropriate. The upper limits of the $V_{HLR}$, $V_{HLG}$, and $V_{HLB}$ are the light emission threshold voltages $Vth_R$, $Vth_G$, and $Vth_B$. If the offset voltages exceed the light emission threshold voltages, a slight light emission during a reset period or a cross-talk light emission on the EL element that is not scanned may be produced. No limitation is imposed on the lower limits of the $V_{LLR}$, $V_{LLG}$, and $V_{LLB}$ in particular. However, in consideration of the power efficiency, the lower limits may be desirably set to within an appropriate range. That is, the parasitic capacitance of an EL element that is located at the intersection of a cathode line that is not scanned and an anode line that is being driven is charged with invalid electric charge, corresponding to the offset voltage, the charge not contributing to light emission. Thus, lower limits are preferably set to within an appropriate range to reduce the amount of electric charge.

If a reverse bias voltage Vcc that satisfies the predetermined allowable ranges $V_{LLR}$ to $V_{HLR}$, $V_{LLG}$ to $V_{HLG}$, and $V_{LLB}$ to $V_{HLB}$, of each of the red, green, and blue colors cannot be set, the reverse bias voltage Vcc is set to a limit value that does not exceed the light emission threshold voltages of EL elements of colors with the maximum voltages $Ve_R$, $Ve_G$, $Ve_B$.

Figure 23:
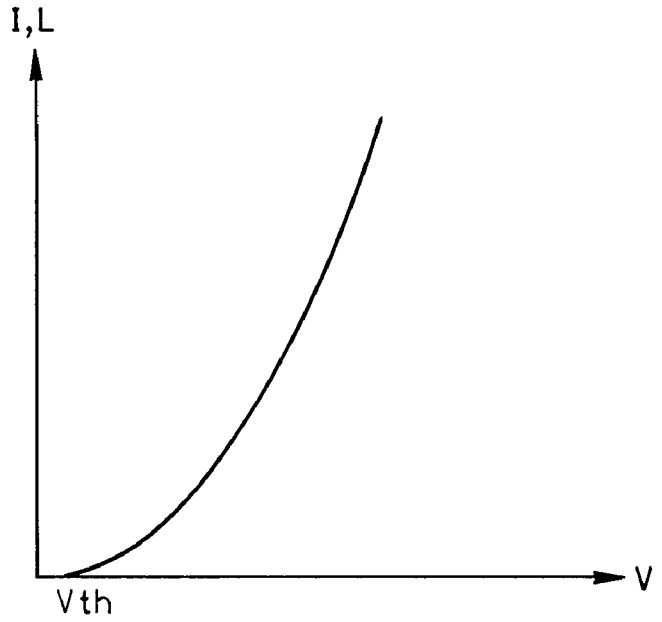
FIG. 23 is a plot showing the voltage V—current I characteristic of an EL element when the total time of light emission is short.
Figure 24:
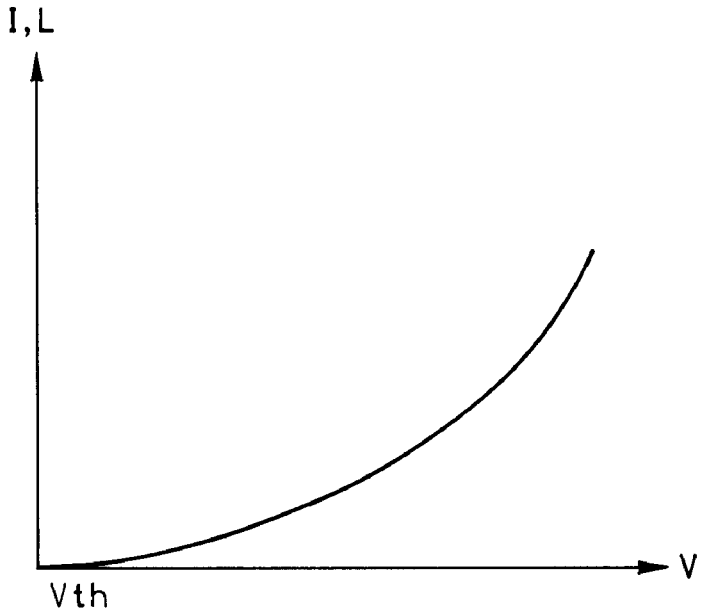
FIG. 24 is a plot showing the voltage V—current I characteristic of an EL element when the total time of light emission is long.

Each of the EL elements of the aforementioned light-emitting display panel deteriorates when allowed to emit light for a long time to cause the V-I characteristic to change. For example, the V-I characteristic is available as shown in FIG. 23 for a total of short time of light emission, however, for a total of long time of light emission, overall current I is reduced for the same value of the voltage V across an EL element as shown in FIG. 24 and thus luminosity L that is proportional to current I is also reduced. Accordingly, it can be thought that the total time of light emission is measured and the V-I characteristic is measured as appropriate in accordance with the time of light emission to compensate for data tables. Currents may be allowed to flow into EL elements at predetermined intervals of current in the measurement, and voltages across the EL elements may be detected to calculate coefficients for compensation.

In the aforementioned embodiment, the voltages $Ve_R$, $Ve_G$, $Ve_B$ across the EL elements for emitting red, green, and blue light, corresponding to the drive currents $I_R$, $I_G$, $I_B$, are set by retrieving data tables. However, functional equations showing the characteristic of drive current—voltage across EL element for each of the red, green, and blue colors may be stored to calculate the voltages $Ve_R$, $Ve_G$, $Ve_B$ across EL elements using the functional equations.

Furthermore, drive currents are supplied to EL elements that should be allowed to emit light from current sources. However, potentials may be applied to current addressing drive lines from voltage sources so that voltages slightly higher than threshold voltages may be applied to the EL elements.

As described above, according to the present invention, variations in voltages across each of capacitive light-emitting elements for emitting light of colors different from each other can be thereby made equal to each other, the variations being produced by the time the voltages reach each desired voltage during a scanning period. Thus, the rise characteristic of each of capacitive light-emitting elements that emit light of colors different from each other can be improved.

What is claimed is:

1. An apparatus for driving a multi-color light-emitting display panel including a plurality of drive lines and a plurality of scanning lines intersecting with each other, and a plurality of capacitive light-emitting elements having polarities connected to said scanning lines and said drive lines at a plurality of intersections of said drive lines and said scanning lines, and being divided into a plurality of types by a color of light emission, said capacitive light-emitting elements of the same color type being arranged on each of said plurality of drive lines, comprising:

scanning means for selectively supplying one of a first potential and a second potential higher than said first potential to each of said plurality of scanning lines;

drive means for selectively supplying one of an output of a current source for applying drive current and a third potential for an offset voltage, equal to or less than a light emission threshold voltage of said element, to each of said plurality of drive lines; and control means for repeatedly setting a scanning period to select one scanning line of said plurality of scanning lines and a subsequent reset period in accordance with a scan timing of input image data, and for designating at least one drive line of said plurality of drive lines corresponding to at least one capacitive light-emitting element which should be emitted light on said one scanning line during said scanning period in accordance with said input image data, wherein said scanning means supplies, during said scanning period, the first potential to said one scanning line and said second potential to scanning lines other than said one scanning line, and supplies, during said reset period, said first potential to all scanning lines, said drive means supplies, during said scanning period, said drive current to said at least one drive line to apply a positive voltage not less than said light emission threshold voltage to said at least one capacitive light-emitting element in the forward direction, and supplies, during said reset period, said third potential to at least one subsequent drive lines to be designated to apply an offset voltage not higher than said light emission threshold voltage to at least one capacitive light-emitting element which should be allowed to emit light during the next scanning period, and said drive current and said third potential are made variable for each type of said capacitive light-emitting elements.

2. An apparatus for driving for a multi-color light-emitting display panel according to claim 1, wherein said drive means has a variable current source for outputting said drive current and a variable voltage source for providing said third potential, corresponding to each of said plurality of drive lines.

3. A driving apparatus according to claim 1, wherein said drive means applies, during said reset period, said first potential to drive lines other than said subsequent drive line.

4. A driving apparatus according to claim 1, comprising hue control input means for outputting luminosity data showing levels of brightness of each color of light emission in accordance with operational input, wherein said control means sets levels of said drive current and said offset voltage for each type of said capacitive light-emitting elements in accordance with said luminosity data, and said drive means varies said third potential to provide the level of said offset voltage set by said control means and varies said drive current to provide the level of said drive current set by said control means.

5. A driving apparatus according to claim 1, wherein said first potential is the ground potential, said second potential is a fixed potential, and said third potential is equal to said offset voltage.

6. A driving apparatus according to claim 1, wherein a voltage applied to the both ends of a capacitive light-emitting element by supplying with said drive current corresponding to the type of said capacitive light-emitting element during said scanning period, is equal to said second potential plus said offset voltage.

7. A driving apparatus according to claim 1, wherein said second potential is variable.

8. A driving apparatus according to claim 7, wherein said scan means has a variable voltage source for providing said second potential, corresponding to each of said plurality of scanning lines.

9. A driving apparatus according to claim 1, comprising hue control input means for outputting luminosity data showing levels of brightness of each color of light emission in accordance with actuation input, wherein said control means sets, in accordance with said luminosity data, a level of said second potential and levels of said drive current and said offset voltage for each type of said capacitive light-emitting elements, said scan means varies said second potential to provide the level of said second potential set said control means, and said drive means varies said third potential to provide the level of said offset voltage set by said control means and varies said drive current to provide the level of said drive current set by said control means.

10. A driving apparatus according to claim 1, wherein said drive current and said third potential are different for each color type of the capacitive light-emitting elements arranged on each of said drive lines.

11. A method for driving a multi-color light-emitting display panel including a plurality of drive lines and a plurality of scanning lines intersecting with each other, and a plurality of capacitive light-emitting elements having polarities connected to said scanning lines and said drive lines at a plurality of intersections of said drive lines and said scanning lines, and being divided into a plurality of types by a color of light emission, said capacitive light-emitting elements of the same color type being arranged on each of said plurality of drive lines, said method comprising the steps of:

repeatedly setting a scanning period to select one scanning line of said plurality of scanning lines and a subsequent reset period in accordance with a scan timing of input image data, designating at least one drive line of said plurality of drive lines corresponding to at least one capacitive light-emitting element which should be emitted light on said one scanning line during said scanning period in accordance with said input image data, supplying, during said scanning period, the first potential to said one scanning line and said second potential to scanning lines other than said one scanning line, and supplying, during said reset period, said first potential to all scanning lines, and supplying, during said scanning period, said drive current to said at least one drive line to apply a positive voltage equal to or greater than said light emission threshold voltage to said at least one capacitive light-emitting element in the forward direction, and supplying, during said reset period, said third potential to at least one subsequent drive line to be designated during a next scanning period to apply an offset voltage equal to or less than said light emission threshold voltage to at least one capacitive light-emitting element which should be allowed to emit light during a next scanning period, said drive current and said third potential being variable for each type of said capacitive light-emitting elements.

12. A driving apparatus according to claim 11, wherein said drive current and said third potential are different for each color type of the capacitive light-emitting elements arranged on each of said drive lines.

* * * * *